United States Patent [19]

Hoffner et al.

[11] 4,121,291

[45] Oct. 17, 1978

[54] LINEARITY CORRECTION SYSTEM FOR ELECTRO-OPTICAL GAGE

[75] Inventors: Joel L. Hoffner; Tom L. Galanis, both of Bethlehem, Pa.

[73] Assignee: Bethlehem Steel Corporation, Bethlehem, Pa.

[21] Appl. No.: 778,513

[22] Filed: Mar. 17, 1977

[51] Int. Cl.[2] ..... B21B 37/00; G06F 15/46

[52] U.S. Cl. ..... 364/571; 364/472; 72/37

[58] Field of Search ..... 235/151.3, 151.1; 72/37, 8; 29/DIG. 32; 356/158, 160, 159, 167, 156; 358/101, 107

[56] References Cited

U.S. PATENT DOCUMENTS

| | | | |
|---|---|---|---|
| 3,676,652 | 7/1972 | Millis, Jr. et al. | 235/151.1 X |
| 3,686,437 | 8/1972 | Leonard | 178/7.6 |
| 3,713,313 | 1/1973 | Spradlin | 235/151.1 X |
| 3,854,822 | 12/1974 | Altman et al. | 356/156 |
| 3,874,798 | 4/1975 | Antonsson et al. | 356/159 |

OTHER PUBLICATIONS

A Microprocessor — Based Gauge Controller for Metals Rolling Applications; D. M. Hershberger, J. G. Underwood; IEEE Transactions on Industrial Electronics and Control Instrumentation, vol. IECI-22, No. 3, Aug. 1975, pp. 333-337.

*Primary Examiner*—Edward J. Wise

*Attorney, Agent, or Firm*—Joseph J. O'Keefe; Michael J. Delaney; John T. Iverson

[57] ABSTRACT

Computerized electro-optical system gages dimension of a moving hot bar. Back-lighted electronic camera head generates high-speed bar shadow pulses which represent the bar dimensions. Bar pulses are processed by way of camera electronics and a digital computer. CRT and printing terminals, interacting with the computer, indicate and/or record a field-of-view correction map and a cold-size bar diameter measurement.

Camera head electronics includes camera AGC, a digital type one-axis bidirectional linear sweep, bar pulse edge-detection with an autocorrelator to remove noise and enhance the bar pulse, and a digital accumulator of digital bar size signals and digital bar position-in-field-of-view signals. The digital computer assimilates bar size and bar position signals along with bar temperature, aim size, and other data signals. The computer is programmed to: (a) compensate bar size signals for field-of-view errors and other optical and electronic nonlinearities, bar temperature and other sources of error; (b) calibrate the gage off-line; and (c) communicate with the CRT and printing terminals and an exterior control system.

18 Claims, 36 Drawing Figures

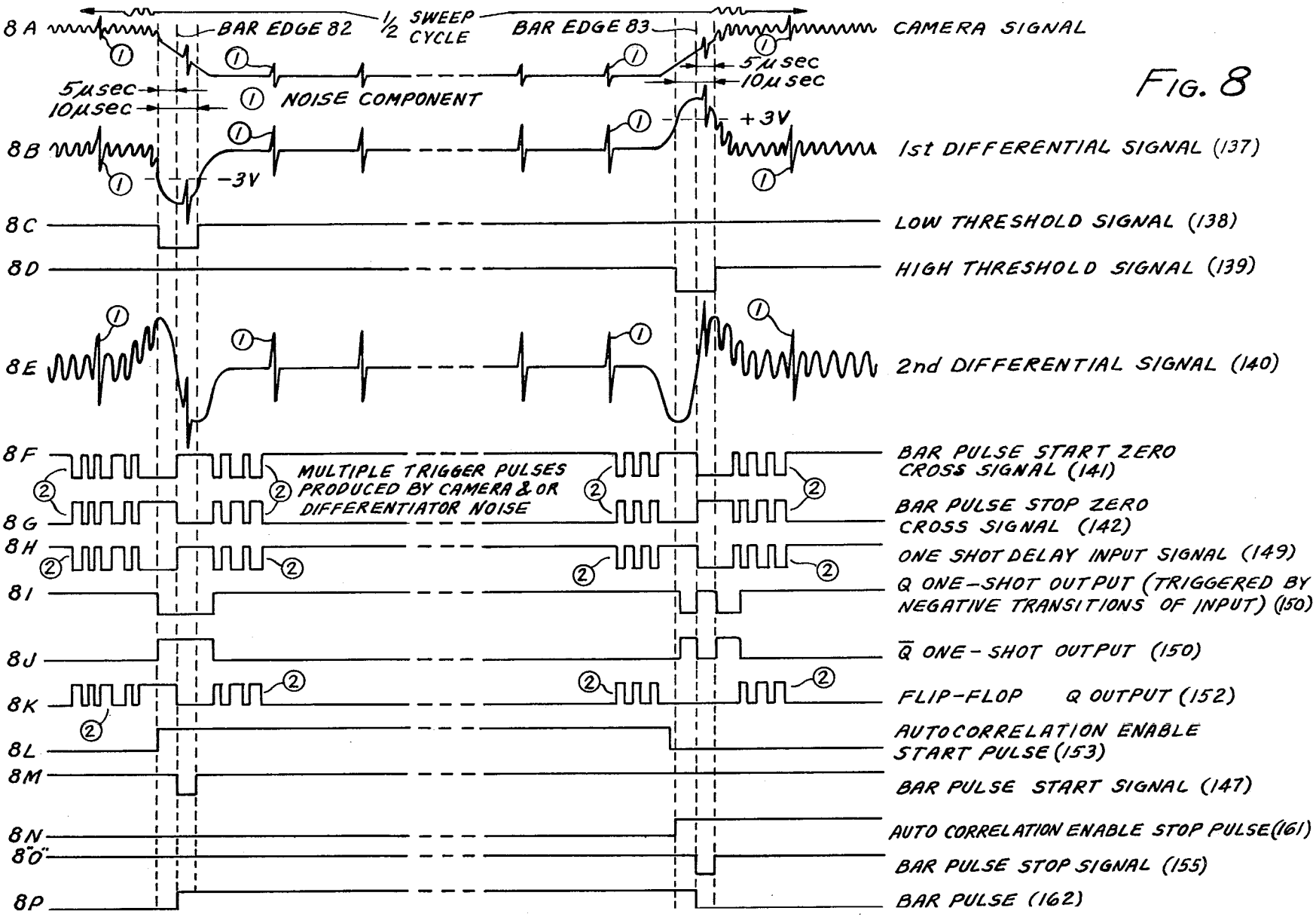
FIG. 8
8A
8B
8C
8D
8E
8F
8G
8H
8I
8J
8K
8L
8M
8N
8O
8P
CAMERA SIGNAL
1st DIFFERENTIAL SIGNAL (137)
LOW THRESHOLD SIGNAL (138)
HIGH THRESHOLD SIGNAL (139)
2nd DIFFERENTIAL SIGNAL (140)
BAR PULSE START ZERO CROSS SIGNAL (141)
BAR PULSE STOP ZERO CROSS SIGNAL (142)
ONE SHOT DELAY INPUT SIGNAL (149)
Q ONE-SHOT OUTPUT (TRIGGERED BY NEGATIVE TRANSITIONS OF INPUT) (150)
Q̄ ONE-SHOT OUTPUT (150)
FLIP-FLOP Q OUTPUT (152)
AUTOCORRELATION ENABLE START PULSE (153)
BAR PULSE START SIGNAL (147)
AUTO CORRELATION ENABLE STOP PULSE (161)
BAR PULSE STOP SIGNAL (155)
BAR PULSE (162)
BAR EDGE 82
BAR EDGE 83
½ SWEEP CYCLE
NOISE COMPONENT
MULTIPLE TRIGGER PULSES PRODUCED BY CAMERA & OR DIFFERENTIATOR NOISE
5μsec
10μsec
+3V
-3V

COMPUTER #3 DISK MAP
FOR GAGE PROGRAMS

HEXADECIMAL CORE MAP

| TYPE | NAME | POSITION IN COMMON AREA | | COMMON NAME | CORE LOCATION | DESCRIPTION |
|---|---|---|---|---|---|---|
| ARRAY | IFLDC1 | 0000 | IN | FCOMP1 | 9700 | HEAD 1 FIELD OF VIEW COMPENSATION MAP |
| ARRAY | IFLDC2 | 0000 | IN | FCOMP2 | 9800 | HEAD 2 FIELD OF VIEW COMPENSATION MAP |
| VARIABLE | IMULT1 | 0000 | IN | CORCOM | 9900 | HEAD 1 SLOPE CORRECTION |
| VARIABLE | IMULT2 | 0001 | IN | CORCOM | 9901 | HEAD 2 SLOPE CORRECTION |
| VARIABLE | IOFST1 | 0002 | IN | CORCOM | 9902 | HEAD 1 OFFSET CORRECTION |
| VARIABLE | IOFST2 | 0003 | IN | CORCOM | 9903 | HEAD 2 OFFSET CORRECTION |
| VARIABLE | ITMP1 | 0000 | IN | TMPOFF | 9904 | HEAD 1 AUTO-RECALIBRATION SLOPE CORRECTION |
| VARIABLE | ITMP2 | 0001 | IN | TMPOFF | 9905 | HEAD 2 AUTO-RECALIBRATION SLOPE CORRECTION |
| VARIABLE | IMASK1 | 0000 | IN | MSKCOM | 9906 | HEAD 1 RIGHT MASK REFERENCE VALUE |
| VARIABLE | IMASK2 | 0001 | IN | MSKCOM | 9907 | HEAD 2 RIGHT MASK REFERENCE VALUE |
| VARIABLE | IWINDX | 0002 | IN | MSKCOM | 9908 | WINDOW FOR NO X DEFLECT & RIGHT DEFLECT FOR HEAD 1 & HEAD 2 |
| VARIABLE | IGAGDM | 0003 | IN | MSKCOM | 9909 | SPARE - NO FUNCTION |
| ARRAY | ILFMSK | 0000 | IN | LEFTCL | 990A | LEFT MASK REFERENCE VALUES FOR HEAD 1 & HEAD 2 |
| ARRAY | IWINDO | 000A | IN | LEFTCL | 9914 | WINDOWS FOR EACH LEFT MASK ON HEAD 1 & HEAD 2 |
| VARIABLE | ISCNST | 0001 | IN | MASGAG | 9E5D | TARGET ANGLE FOR POSITIONING PROGRAM "GAGPOS" |
| VARIABLE | IBANGL | 0002 | IN | MASGAG | 9E5E | ANGULAR POSITION OF SCANNER IN COUNTS (255=90°) |
| VARIABLE | IANGLE | 0003 | IN | MASGAG | 9E5F | ANGULAR POSITION OF SCANNER IN DEGREES |
| VARIABLE | NSAMPL | 0006 | IN | MASGAG | 9E62 | THE NUMBER OF SAMPLES TO BE AVERAGED PER READING |
| ARRAY | IBDGT1 | 0007 | IN | MASGAG | 9E63 | PROFILE TABLE (CONTAINS 90-2° SLOTS) |
| ARRAY | IBDGT2 | 0065 | IN | MASGAG | 9EC1 | HISTOGRAM TABLE FOR HEAD 1 & HEAD 2 |
| ARRAY | IBDGT3 | 010C | IN | MASGAG | 9F68 | HISTOGRAM TABLE FOR DIFFERENCE BETWEEN HEAD 1 & HEAD 2 |
| VARIABLE | IDVLIM | 0161 | IN | MASGAG | 9FBD | MAXIMUM ALLOWABLE DEVIATION |
| VARIABLE | ICLFLG | 0162 | IN | MASGAG | 9FBE | CALIBRATION FLAG (PREVENTS CALLS TO CMPNST) |
| VARIABLE | IDEV1 | 0163 | IN | MASGAG | 9FBF | DEVIATION OF HEAD 1 FOR A SINGLE READING |
| VARIABLE | IDEV2 | 0164 | IN | MASGAG | 9FC0 | DEVIATION OF HEAD 2 FOR A SINGLE READING |
| VARIABLE | IPOS1 | 0165 | IN | MASGAG | 9FC1 | BAR POSITION OF HEAD 1 FOR A SINGLE READING |
| VARIABLE | IPOS2 | 0166 | IN | MASGAG | 9FC2 | BAR POSITION OF HEAD 2 FOR A SINGLE READING |
| VARIABLE | NGOOD1 | 0167 | IN | MASGAG | 9FC3 | FOR HEAD 1 - # OF GOOD SAMPLES AVERAGED IN A READING |
| VARIABLE | NGOOD2 | 0168 | IN | MASGAG | 9FC4 | FOR HEAD 2 - # OF GOOD SAMPLES AVERAGED IN A READING |
| VARIABLE | IERR | 0000 | IN | GAGERR | 57FB | GAGE ERROR CODE |
| VARIABLE | IRECAL | 0001 | IN | GAGERR | 57FC | RECALIBRATION FLAG (FALSE = NO RECALIBRATION DONE) |
| VARIABLE | IHMD2 | 0001 | IN | BDCCOM | 5701 | HOT METAL DETECTOR - FINISHING STAND |
| VARIABLE | ICDAIM | 0028 | IN | BDCCOM | 5728 | COLD AIM SIZE |
| VARIABLE | IGRADE | 0029 | IN | BDCCOM | 5729 | % CARBON |
| VARIABLE | IHAIM1 | 002A | IN | BDCCOM | 572A | HOT AIM SIZE FOR HEAD 1 |
| VARIABLE | IHAIM2 | 002B | IN | BDCCOM | 572B | HOT AIM SIZE FOR HEAD 2 |

FIG. 13

GAGTSK (FUNCTIONAL FLOWCHART)

GAGTSK

SUBCLL

GAGE OFFLINE SYSTEM

MNEMONICS ARE AS FOLLOWS:

MP - BUILDS FIELD OF VIEW COMPENSATION MAPS
TY - PRINTS MAPS, SLOPE & OFFSET FACTORS, AND MASK VALUES
OF - ALLOWS ENTRY OF SLOPE AND OFFSET CORRECTION FACTORS
ZE - ZEROES ALL MAPS AND CORRECTION FACTORS !!!CAUTION!!!
TR - DISK TRANSFER OF GAGE COMMON TO CONTROL SYS. AREA
XT - EXITS TO MONITOR AND ATTEMPTS TO WRITE COMMON AREA CONTAINING MAPS, SLOPE AND OFFSET CORRECTION FACTORS, AND WINDOW VALUES TO THE DISK. THE DISK FILE WILL ONLY BE UPDATED IF DISK SWITCH 12 IS UP. THIS FILE IS READ FROM THE DISK WHEN THIS TASK (20) IS CALLED BY THE MONITOR.

FIG. 18B

GAGMAP

GAGMAP

DATE

TIME

FIELD OF VIEW COMPENSATION MAP

| | -1.6 | -1.2 | -0.8 | -0.4 | 0.0 | +0.4 | +0.8 | +1.2 | +1.6 |
|---|---|---|---|---|---|---|---|---|---|
| 0.000 | 99.0 | -1.0 | -1.0 | -0.2 | 0.0 | 0.4 | 2.8 | 10.2 | 108.0 |
| 0.016 | 98.8 | -0.8 | -1.0 | -0.2 | 0.0 | 0.6 | 3.0 | 10.6 | 108.4 |
| 0.032 | 99.0 | -0.8 | -1.0 | 0.0 | 0.0 | 0.4 | 3.2 | 11.0 | 108.8 |
| 0.048 | 3.0 | -1.0 | -1.0 | 0.0 | 0.0 | 0.6 | 3.2 | 11.6 | 109.2 |
| 0.064 | 3.0 | -1.0 | -1.0 | 0.0 | 0.0 | 0.6 | 3.6 | 12.0 | 109.6 |
| 0.080 | 2.6 | -1.0 | -1.0 | 0.0 | 0.0 | 0.6 | 3.8 | 12.8 | 110.2 |
| 0.096 | 2.4 | -1.2 | -0.8 | 0.0 | 0.0 | 0.8 | 4.2 | 13.4 | 110.6 |
| 0.112 | 2.0 | -1.0 | -0.8 | 0.0 | 0.0 | 0.8 | 4.2 | 14.2 | 111.0 |
| 0.128 | 1.8 | -1.4 | -0.8 | 0.0 | 0.0 | 0.8 | 4.4 | 14.6 | 111.6 |
| 0.144 | 1.4 | -1.2 | -0.8 | 0.0 | 0.0 | 1.0 | 4.8 | 15.6 | 112.0 |
| 0.160 | 1.2 | -1.2 | -0.8 | 0.0 | 0.0 | 1.0 | 4.8 | 16.4 | 112.8 |
| 0.176 | 1.0 | -1.0 | -0.8 | 0.0 | 0.0 | 1.2 | 5.2 | 17.2 | 113.4 |
| 0.192 | 0.6 | -1.2 | -0.6 | 0.0 | 0.0 | 1.2 | 5.4 | 17.8 | 114.2 |
| 0.208 | 0.4 | -1.2 | -0.8 | 0.0 | 0.0 | 1.2 | 5.6 | 18.8 | 114.6 |
| 0.224 | 0.2 | -1.2 | -0.6 | 0.0 | 0.0 | 1.4 | 6.0 | 19.6 | 115.6 |
| 0.240 | 0.0 | -1.2 | -0.6 | 0.0 | 0.0 | 1.4 | 6.2 | 20.4 | 116.4 |
| 0.256 | -0.2 | -1.2 | -0.4 | 0.0 | 0.0 | 1.6 | 6.8 | 21.2 | 117.2 |
| 0.272 | -0.2 | -1.2 | -0.4 | 0.0 | 0.0 | 1.6 | 7.0 | 105.4 | 117.8 |
| 0.288 | -0.2 | -1.2 | -0.4 | 0.0 | 0.0 | 1.8 | 7.2 | 105.6 | 118.8 |
| 0.304 | -0.4 | -1.2 | -0.4 | 0.0 | 0.0 | 1.8 | 7.8 | 106.0 | 119.6 |
| 0.320 | -0.6 | -1.2 | -0.4 | 0.0 | 0.2 | 2.0 | 8.0 | 106.2 | 120.6 |
| 0.336 | -0.8 | -1.2 | -0.4 | 0.0 | 0.2 | 2.2 | 8.4 | 106.8 | 121.2 |
| 0.352 | -0.8 | -1.0 | -0.2 | 0.0 | 0.2 | 2.2 | 8.8 | 107.0 | 205.4 |
| 0.368 | -1.0 | -1.0 | -0.2 | 0.0 | 0.2 | 2.4 | 9.2 | 107.2 | 205.6 |
| 0.384 | -1.0 | -1.0 | -0.2 | 0.0 | 0.4 | 2.4 | 9.6 | 107.8 | 206.0 |

FIG. 21C

GAGE CALIBRATION DATA

DATE TIME

FIELD OF VIEW COMPENSATION MAP

| | -1.6 | -1.2 | -0.8 | -0.4 | 0.0 | +0.4 | +0.8 | +1.2 | +1.6 |
|---|---|---|---|---|---|---|---|---|---|
| 0.000 | 99.0 | -1.0 | -1.0 | -0.2 | 0.0 | 0.4 | 2.8 | 10.2 | 108.0 |
| 0.016 | 98.8 | -0.8 | -1.0 | -0.2 | 0.0 | 0.6 | 3.0 | 10.6 | 108.4 |
| 0.032 | 99.0 | -0.8 | -1.0 | 0.0 | 0.0 | 0.4 | 3.2 | 11.0 | 108.8 |
| 0.048 | 3.0 | -1.0 | -1.0 | 0.0 | 0.0 | 0.6 | 3.2 | 11.6 | 109.2 |
| 0.064 | 3.0 | -1.0 | -1.0 | 0.0 | 0.0 | 0.6 | 3.6 | 12.0 | 109.6 |
| 0.080 | 2.6 | -1.0 | -1.0 | 0.0 | 0.0 | 0.6 | 3.8 | 12.8 | 110.2 |
| 0.096 | 2.4 | -1.2 | -0.8 | 0.0 | 0.0 | 0.8 | 4.2 | 13.4 | 110.6 |
| 0.112 | 2.0 | -1.0 | -0.8 | 0.0 | 0.0 | 0.8 | 4.2 | 14.2 | 111.0 |
| 0.128 | 1.8 | -1.4 | -0.8 | 0.0 | 0.0 | 0.8 | 4.4 | 14.6 | 111.6 |
| 0.144 | 1.4 | -1.2 | -0.8 | 0.0 | 0.0 | 1.0 | 4.8 | 15.6 | 112.0 |
| 0.160 | 1.2 | -1.2 | -0.8 | 0.0 | 0.0 | 1.0 | 4.8 | 16.4 | 112.8 |
| 0.176 | 1.0 | -1.0 | -0.8 | 0.0 | 0.0 | 1.2 | 5.2 | 17.2 | 113.4 |
| 0.192 | 0.6 | -1.2 | -0.6 | 0.0 | 0.0 | 1.2 | 5.4 | 17.8 | 114.2 |
| 0.208 | 0.4 | -1.2 | -0.8 | 0.0 | 0.0 | 1.2 | 5.6 | 18.8 | 114.6 |
| 0.224 | 0.2 | -1.2 | -0.6 | 0.0 | 0.0 | 1.4 | 6.0 | 19.6 | 115.6 |
| 0.240 | 0.0 | -1.2 | -0.6 | 0.0 | 0.0 | 1.4 | 6.2 | 20.4 | 116.4 |
| 0.256 | -0.2 | -1.2 | -0.4 | 0.0 | 0.0 | 1.6 | 6.8 | 21.2 | 117.2 |
| 0.272 | -0.2 | -1.2 | -0.4 | 0.0 | 0.0 | 1.6 | 7.0 | 105.4 | 117.8 |
| 0.288 | -0.2 | -1.2 | -0.4 | 0.0 | 0.0 | 1.8 | 7.2 | 105.6 | 118.8 |
| 0.304 | -0.4 | -1.2 | -0.4 | 0.0 | 0.0 | 1.8 | 7.8 | 106.0 | 119.6 |
| 0.320 | -0.6 | -1.2 | -0.4 | 0.0 | 0.2 | 2.0 | 8.0 | 106.2 | 120.6 |
| 0.336 | -0.8 | -1.2 | -0.4 | 0.0 | 0.2 | 2.2 | 8.4 | 106.8 | 121.2 |
| 0.352 | -0.8 | -1.0 | -0.2 | 0.0 | 0.2 | 2.2 | 8.8 | 107.0 | 205.4 |
| 0.368 | -1.0 | -1.0 | -0.2 | 0.0 | 0.2 | 2.4 | 9.2 | 107.2 | 205.6 |
| 0.384 | -1.0 | -1.0 | -0.2 | 0.0 | 0.4 | 2.4 | 9.6 | 107.8 | 206.0 |

OFFSET CORRECTION= 16
SLOPE CORRECTION = 13

| | | WINDOW |
|---|---|---|
| LEFT MASK 1 | 0.2158 | 00AA |
| LEFT MASK 2 | 0.2140 | 012E |
| LEFT MASK 3 | 0.2142 | 0191 |
| LEFT MASK 4 | 0.2148 | 01F4 |
| LEFT MASK 5 | 0.2178 | 0278 |
| RIGHT MASK | 0.5006 | 005C |

FIG. 24B

LINEARITY CORRECTION SYSTEM FOR ELECTRO-OPTICAL GAGE

CROSS-REFERENCES TO RELATED APPLICATIONS

The following co-pending applications owned by the same assignee are incorporated as follows:

| Cross-Reference | Title |
|---|---|
| (A) | "Scanning Pyrometer System", by J. J. Roche et al Serial No. 522,363, filed 11-8-74. |
| (B) | "Magnetically Shielded Image Dissector Tube Assembly" by J. C. Clymer et al, filed concurrently herewith. |

BACKGROUND OF THE INVENTION

1. Field of the Invention

This invention relates broadly to electro-optical gaging methods and systems. More particularly, this invention relates to an electro-optical method and system for gaging dimensions of an object and correcting for system nonlinearities. The invention may be used to determine a lateral dimension of a moving hot bar during bar rolling in a steel mill as is disclosed herein. Similarly, the invention may be used to gage the dimensions of other shaped objects and in other environments as well.

2. Description of the Prior Art

Generally, in steel mills where hot round bars are rolled, productivity demands require that a variety of bars be rolled at speeds of up to 4000 ft./min. (1219 m.) and sizes of up to three inches in diameter (7.62 cm.) while the bar rolling temperature is about 1700° F. (930° C.). Further demands require that the specifications on finished cold bar size and out-of-roundness be within one-half existing commercial tolerances. In order to meet these requirements, a computer-controlled rolling process must be implemented that will combine order data with operating measurements to produce mill control signals that will maximize productivity while minimizing, or desirably eliminating, off-specification product.

Some of the operating data used in mill control computer calculations and referred to herein are: desired bar diameter, or aim size; aim size full- and half-commercial tolerances; and bar grade, or percent carbon composition of the bar to be rolled. One of the operating measurements mentioned above and of particular importance is actual bar diameter, or bar size. Another operating measurement is bar temperature, a parameter used to correct for hot bar shrinkage in both bar measurement and computer control aspects of mill operation.

In order that the mill control computer may be programmed to meet the strict requirements of mill speed, bar size and size half-tolerances, it is desirous that all operating measurements have the following characteristics. Bar size measurements be made when the bar vibrates in a lateral orbit while moving longitudinally during rolling; be made at repetitive rates of about 300 Hz.; have a resolution of 0.0005 inch; have an absolute accuracy equivalent to one-quarter commercial tolerance; maintain a high degree of reliability; all measurements made under the severe environment normally present in a steel rolling mill. Bar temperature measurements should have similar characteristics.

Several types of electro-optical gaging systems are available to measure bar size. One early type of bar size gaging system operates on the self-illumination principle in which chopped infrared radiation from the hot bar is imaged through a lens onto an infrared detector. Elementary edge-detection circuitry was used in an attempt to define raw detector pulses in relation to bar edges.

Three more recent electro-optical systems applicable to bar size measurements operate on the principle of back-lighting a test object to be measured and imaging a shadow of the object through a lens onto the face of an electronic camera. In one such gaging system, a scanning laser beam illuminates the test object and the lens system focuses the object shadow onto a phototransistor. In a second such gaging system, a stationary light source of fixed intensity illuminates the test object and the lens system focuses the object shadow onto an electronically scanned image orthicon tube having two-axis unidirectional scanning. In the third such system, the image orthicon tube is replaced by a self-scanning photodiode array.

The photoresponsive device in each of the three back-lighted gaging systems generates a raw camera pulse having a width that approximates the object dimension between shadow edges. Raw camera pulses are processed in edge detection circuitry having either plain differentiators or gated differentiators which further attempt to more closely define camera pulse width in relation to the object dimension.

Each of the foregoing prior art electro-optical bar size gaging systems has met with varying degrees of success in certain types of installations. However, none of these gaging systems is entirely satisfactory to use as a bar dimension gaging system in the environment of a contemporary high-speed hot steel bar rolling mill. Such gaging systems fail to meet the foregoing measurement requirements for one or more of the following reasons.

Difficulties with prior art gaging systems are first, the object to be measured must be confined to a given position in the camera field-of-view. Second, inability to provide sufficient camera speed-of-response and/or camera resolution. Third, inability to meet system accuracy at high repetition rates because considerable switching noise occurs at such measuring speeds and differentiator noise is also particularly troublesome. In addition, some environmental electrical noise is present in varying degrees which further compounds the problem of making definitive bar measurements at high speeds and high reliability. Fourth, inability or insufficient capability to correct for such error sources as optical and electronic nonlinearities, all of which affect gaging system accuracy. Fifth, instability which causes drift in system calibration. Sixth, inability to compensate or correct for distortion resulting from high frequency lateral vibration of the bar.

SUMMARY OF THE INVENTION

A main object of this invention is to provide an improved electro-optical gaging method and system.

One other object of this invention is to provide an improved electro-optical gaging method and system which has a high response speed, a high repetition rate of measurement, a high accuracy, a high stability and/or a high reliability in the environment of a contemporary high-speed hot steel bar rolling mill.

Another object of this invention is to provide an improved electro-optical gaging method and apparatus which permits accurate measurement of an object when placed at any position in a camera field-of-view, including while the object is vibrating in an orbit lateral to longitudinal movement of the object.

Another object of this invention is to provide an improved electro-optical gaging method and system which determines both object size and object variable position in a camera field-of-view.

Still another object of this invention is to provide an improved electro-optical gaging method and system which processes a camera signal to remove noise combined with an object size pulse in the camera signal, thereby permitting precise definitions of the object size pulse and/or object position in the camera field-of-view.

Yet another object of this invention is to provide an improved electro-optical gaging method and system which corrects camera object size signals for optical and electronic nonlinearities and/or other sources of error.

Still a further object of this invention is to provide an improved electro-optical gaging method and system which displays and/or records a corrected dimension of the object gaged.

The foregoing objects may advantageously be attained for use in a hot bar rolling mill, for example, by a computerized electro-optical system for gaging a dimension of a moving and vibrating hot bar by using a back-lighted electronic camera head. The camera head is provided with electronics which include camera AGC and a digital bidirectional sweep generator for one-axis scan of the camera. Additional electronics process a bar shadow pulse in pulse edge-detection circuitry having an autocorrelator to remove noise. Other electronics include a digital accumulator which provides digital bar size and bar position-in-field-of-view signals.

The camera's bar size and bar position signals, bar temperature, aim size and other signals are assimilated by a digital computer which is programmed to perform the following functions either off-line or on-line. First, correct the bar size signal by digitally compensating for field-of-view errors, other optical and electronic nonlinearities, bar temperature and other sources of errors, thereby providing highly accurate bar diameter measurements anywhere in the f.o.v. Second, calibrate the gage off-line. Third, facilitate interaction with CRT and printing terminals to indicate and/or record the camera's corrected bar diameter measurement. The computer is adapted to communicate corrected bar diameter data to a rolling mill control system when requested by the control system.

BRIEF DESCRIPTION OF THE DRAWINGS

FIG. 8 is a timing diagram of various raw camera signal, differentiator, autocorrelator and bar pulses occurring in the pulse processor shown in FIG. 6.

FIG. 13 is a computer CORE MAP.

FIGS. 14A–E, 15, 16, 17A–B, 18A–B and 19 are flow charts of computer SERVICE PROGRAMS.

FIGS. 21A–C, 22, 23, 24A–C, 25 and 26 are flow charts of computer COMPENSATION PROGRAMS.

DESCRIPTION OF THE PREFERRED EMBODIMENT

Figure 1:
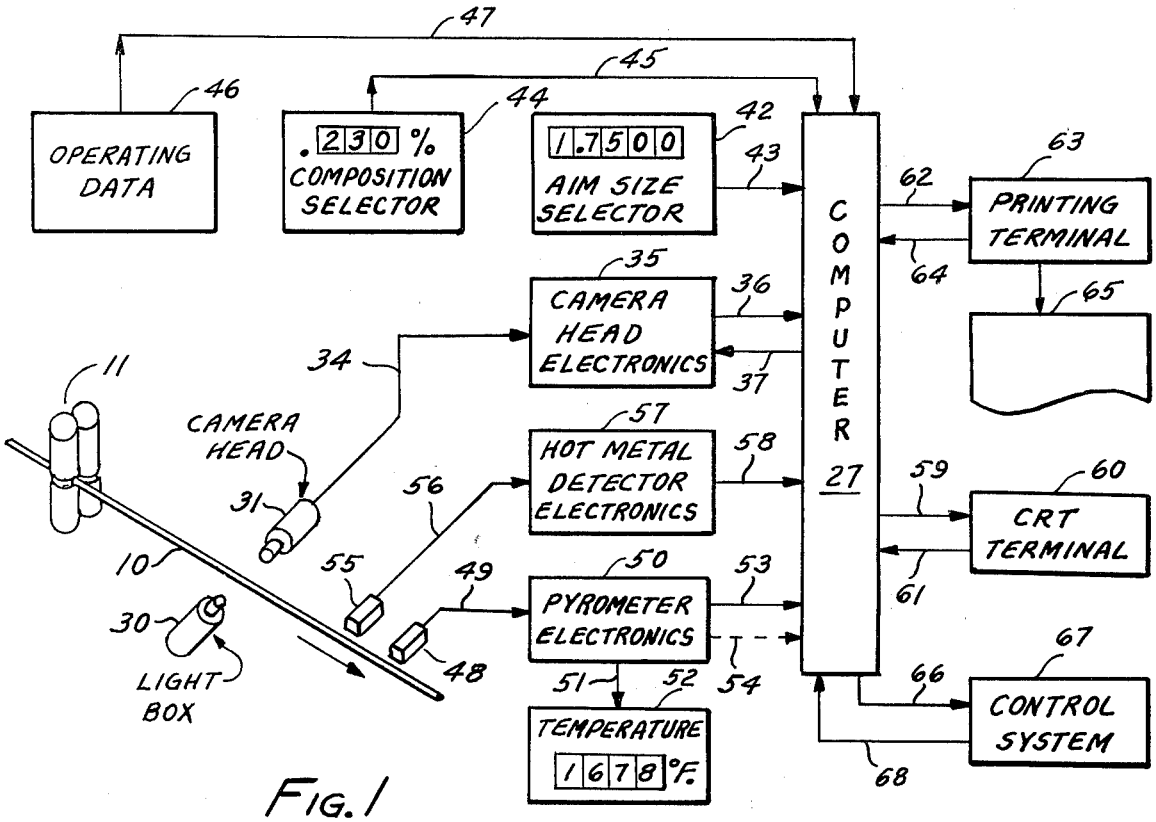
FIG. 1 is a block diagram of the overall computerized electro-optical gaging system.

Referring now to the drawings, particularly FIG. 1, there is shown a computerized electro-optical gaging system having a back-lighted camera mounted in a hot steel bar rolling mill. The gaging system measures the diameter of bar 10, for example, beyond the exit side of roll stand 11. As explained below, the bar diameter signal is fed to a computer which corrects it for optical and electronic nonlinearities. Ultimately, the corrected diameter bar data is displayed, recorded and transmitted to a rolling mill control system which uses this data to set the lateral gap of the rolls in stand 11 to establish the aim size of bar 10.

Figure 3:
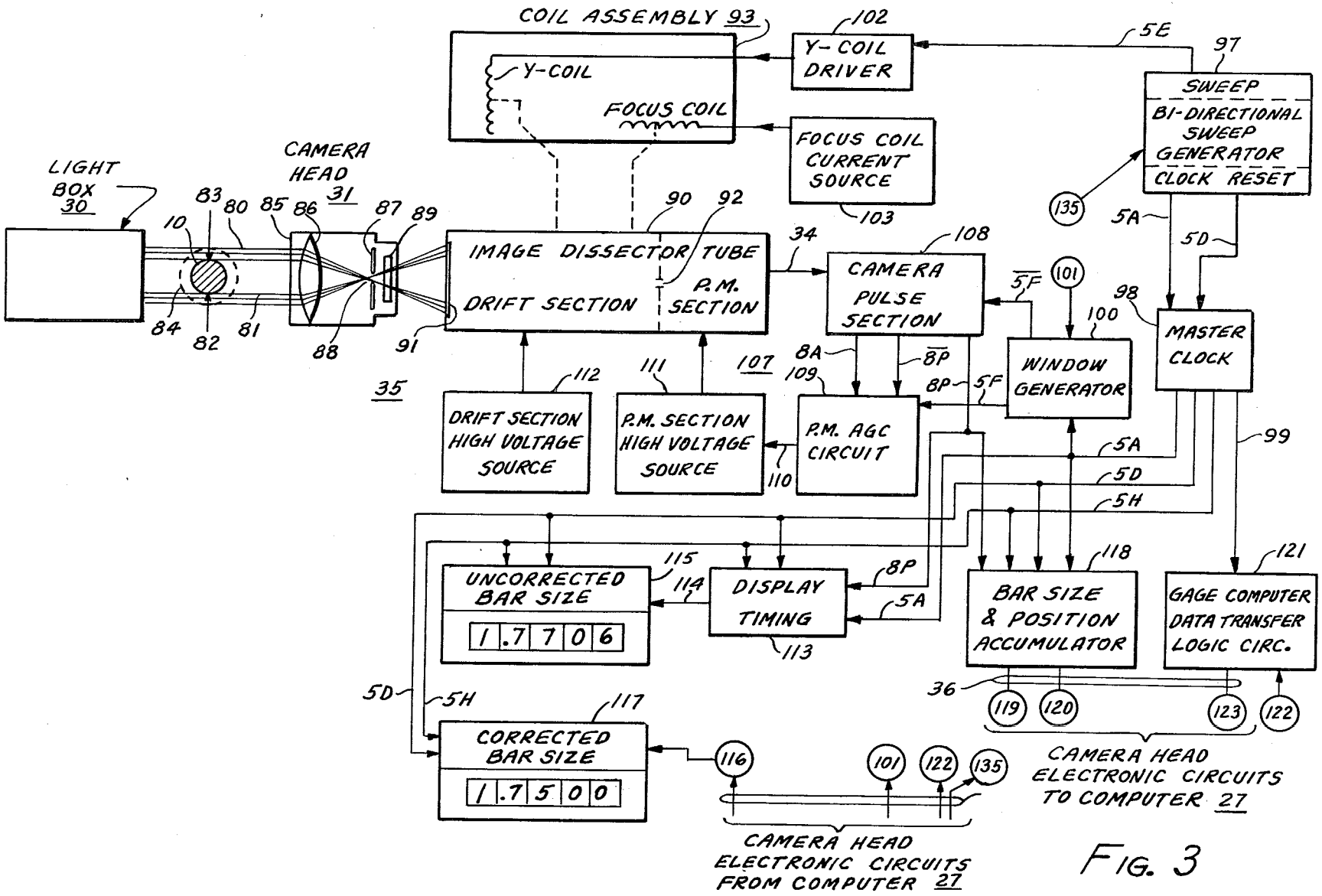
FIG. 3 is a block diagram of camera electronics for the camera system shown in FIG. 1.

More specifically, light box 30 is located opposite electronic camera head 31 so that when bar 10 intercepts light from box 30 a bar shadow having a width proportional to bar diameter at a lateral position will be imaged on electronic camera head 31. A typical arrangement of a back-lighted camera head is shown in FIG. 3 and described below.

Light box 30 is arranged to produce a light source perpendicular to bar 10 larger than the largest size bar 10 to be gaged in the camera field-of-view. For example, the camera field-of-view referred to below is 3 inches (7.62 cm.) and the light source used therewith is 4 inches (10.16 cm.). In addition, the wavelength and intensity of light box 30 must be compatible with the sensitivity characterisitcs of electronic camera head 31. Typically, blue light from a D.C. fired fluorescent light source is preferred for the electronic camera head described below.

The shadow of bar 10, together with excess light beyond bar 10 edges directed from back light box 30, causes electronic camera head 31 to generate a camera signal. This signal consists of a raw camera pulse mixed with noise which is fed over wire 34 to first camera electronics 35. As described below in connection with FIG. 3, the camera signal is processed to remove the noise and produce digital bar size and bar position signals which are fed over cable 36 to computer 27. Gage enable and other signals are fed over cable 37 from computer 27 to camera electronics 35.

Computer 27 in the present electro-optical bar gaging system also receives bar 10 aim size digital signals from thumbwheel selector 42 by way of cable 43. Aim size signals, exemplified as 1.7500 inches (4.445 cm.), are used to determine bar 10 size deviation and other purposes described below. In addition, computer 27 also receives a bar 10 composition digital signal from thumbwheel selector 44 by way of cable 45. Composition signal, which is exemplified as 0.230% and represents percent carbon in the bar 10, is used as a factor in correcting hot bar 10 size for shrinkage and other purposes described below. Further, computer 27 also receives appropriate order data signals, including date, time and size tolerances for bar 10, from source 46 by way of cable 47. Alternatively, any one or all of the aim size signals, composition signals, and other data signals may be supplied by a control system directly associated with rolling bar 10, depending upon the preference of the bar gaging system user.

In order to make temperature corrections to the diameter measurements of moving hot bar 10, a Land Co. optical pyrometer head 48 is provided adjacent scanner 12 and aimed at moving hot bar 10. Optical pyrometer head 48 is adapted to generate a high-response raw temperature signal which is fed over cable 49 to Land Co. pyrometer electronics 50. The raw temperature signal is corrected by scaling and linearizing circuits in pyrometer electronics 50 and the corrected temperature signal, exemplified as 1670° F. (910° C.), is fed over cable 51 to digital indicator 52. In addition, the corrected temperature signal is fed over cable 53 to to computer 27 where it is used to compensate hot bar 10 for shrinkage.

Installation problems may preclude a Land Co. optical pyrometer head 48 and pyrometer electronics 50 from providing a corrected temperature signal to computer 27 and indicator 52 with desired accuracy and rate of response. If such is the case, an alternative to the Land Co. pyrometer arrangement may be to replace it with an optical field scanning pyrometer system disclosed in cross-reference (A). Briefly, the optical field scanning pyrometer system consists of a rapidly oscillating mirror mounted in a pyrometer head and aimed at a field-of-view through which hot bar 10 will travel. The hot bar is imaged through a slit and onto a high-response infrared detector in the pyrometer head. The infrared detector feeds a peak detector and sample-and-hold circuits to measure and store a nonlinear signal of bar 10 temperature. The stored nonlinear signal may be fed over cable 53 to computer 27 where it must be scaled and/or linearized. The stored temperature signal is updated every scan of the oscillating mirror, for example every 20 ms., by a busy-ready flag pulse fed over dotted-line cable 54. In addition, the stored temperature is scaled in linearized with less frequent up-dating and may be fed to bar temperature indicator 52. Provisions are made for adjusting field scanning frequency and width of field-of-view to suit a variety of installations.

The on-line bar gaging system is initiated each time the head end of hot bar 10 is detected in the immediate area of the gage. For this reason, hot metal detector 55 detects the presence and absence of hot bar 10 and feeds a corresponding signal over wire 56 to hot metal detector electronics 57. A presence/absence signal is fed over cable 58 to computer 27 where it initiates the automatic transfer mentioned above.

All camera signals, aim size signal, composition signal, other signals, temperature signal and hot metal presence/absence signal fed over respective cables 36, 43, 45, 47, 53 and 58 are assimilated by computer 27 to perform a variety of functions under control of a group of computer off-line and on-line programs detailed below. One of these functions is to feed bar diameter data and correction data from computer 27 over cable 59 to CRT terminal 60, and to accept interaction between a standard keyboard on terminal 60 and computer 27 by way of cable 61.

Another function of computer 27 is to feed bar diameter data and correction data from computer 27 over cable 62 to printing terminal 63, and to accept interactions between a standard keyboard on terminal 63 and computer 27 by way of cable 64. Printing terminal 63 produces printout 65 such as a data log or a correction map. Still another function of computer 27 is to feed bar 10 diameter data over cable 66 to control system 67 in response to corresponding request signals fed back to computer 27 by way of cable 68.

Figure 2:
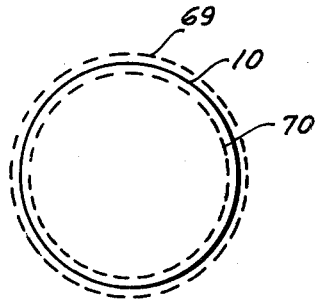
FIG. 2 is a diagram of a bar cross-section showing maximum and minimum tolerance limits in dotted circles.

Turning now to FIG. 2, there is shown a cross-sectional diagram illustrating the lateral profile of bar 10. Dotted circular lines 69 and 70 are illustrative of maximum and minimum standard commercial tolerances for aim size diameter. Bar aim size is 1.7500 inches for illustrative purposes.

It should be noted that the display on CRT terminal 60 is substantially the same as computer printout 65. Thus, CRT terminal 60 displays bar diameter data and correction data information in a form that is unique and quite useful to an operator of the bar gaging system as well as an operator of a rolling mill where the bar gage is used.

ELECTRONIC CAMERA HEAD

A typical back-lighted electronic camera head used in the present electro-optical bar gaging system is shown in FIG. 3 as camera head 31 placed along an optical axis on the opposite side of bar 10 from light box 30. This arrangement illuminates field-of-view 80 and produces bar shadow 81 that varies vertically proportional to the lateral dimension between hot bar edges 82, 83. An end view of hot bar 10 makes it appear stationary but in actual practice bar 10 vibrates in orbit 84 while traveling longitudinally at speeds up to 4000 ft./min. (1219 m./min.). For this reason, hot bar shadow 81 not only varies vertically proportional to bar size, but is also displaced horizontally and vertically within the confines of about a 3 inch diameter bar orbit 84. This phenomenon requires a larger field-of-view 80 than does a stationary bar, thereby increasing the problems of precision bar measurements.

Because the bar shadow 81 varies vertically and its position varies both horizontally and vertically, camera head 31 is provided with telecentric lens system 85 which is designed to admit only parallel light rays with a focal plane extending from at least the nearest horizontal edge of bar orbit 84 to at least the farthest horizontal edge of bar orbit 84. This is accomplished by seven-element lens 86 having a 4-inch field-of-view 80 within which 3 inch bar orbit 84 is centered vertically. Other properties of lens 86 include an image size reduction of 1:2 and a telecentric lens stop 87 having a very narrow horizontal optical aperture 88 through which bar shadow 81 passes. Transmission of bar shadow 81 is limited by optical filter 89 to pass only blue light from light box 30, thereby eliminating undesirable effects of other light sources in the field-of-view which have different wavelengths.

Accordingly, telecentric lens system 85 produces a horizontally-oriented bar shadow 81 that varies vertically between bar edges 82, 83 and remains sharply in focus while bar 10 vibrates in orbit 84. Bar shadow 81 is the same size along the optical axis, but as it is displaced vertically away from the optical axis in either direction it becomes larger according to a nonlinear function. This phenomenon is caused by a combination of electronic, coil and lens nonlinearities and is referred to as field-of-view error which will be corrected by computer 27 as described below.

Bar shadow 81 transmitted by telecentric lens system 85 is imaged upon image responsive device 90 which is capable of being scanned at 300 Hz., has a resolving power of at least 1 part in 10,000, and has a high sensitivity to blue light. Preferably, device 90 is an image dissector (I.D.) tube having photocathode electrode 91 with a central image translating area which receives the bar shadow 81 image. Photocathode electrode 91 is located behind a ligh-transmitting face in the drift section of I.D. tube 90. Photoelectrons emitted by photocathode electrode 91 are focused by external means to pass through electron aperture 92 so they can enter the photomultiplier (P.M.) section of image dissector tube 90. Preferably, device 90 is an ITT Co. high resolution image dissector tube No. F4052RP.

Camera head 31 also includes cylindrical deflection and focus coil assembly 93 surrounding the cylindrical body of image dissector tube 90. Coil assembly 93 includes Y-axis deflection coils and a focus coil, each energized from separate external sources. Standard mu metal shielding surrounds the exterior cylindrical wall of coil assembly 93, thereby providing effective shielding against radial magnetic fields. A preferred coil assembly 93 designed for use with the above noted I.D. tube 90 is Washburn Laboratory, Inc. No. YF2308-CC3C.

Occasionally, the standard mu metal shielding in the Washburn Laboratory, Inc. coil assembly 93 may not provide enough shielding against both radial and axial magnetic field sources. For example, when I.D. tube 90 is operating at a high sensitivity level, electrical equipment generating strong magnetic fields in the vicinity of the gage may cause I.D. tube 90 output to change. If this condition is encountered in practice, an alternative solution exists which requires modifying the Washburn standard mu metal shielding to improve the attenuation of axial magnetic fields according to the teachings in cross-reference (B). Essentially, this involves extending the standard Washburn cylindrical mu metal shield axially toward lens system 85 and closing down the end at filter 89, except for an optical aperture to image bar shadow 81 onto photocathode electrode 91 in tube 90. Additional axial magnetic field attenuation may be achieved by a second cylindrical mu metal shield surrounding the extended standard shield. Moreover, the standard coil shield may be used without extension, but axial field attenuation may be achieved by adding a second and possibly a third cylindrical mu metal shield extending axially as in the first instance.

Still referring to FIG. 3, during all bar gaging system operations a single-axis bidirection sweep signal is applied to the Y-axis deflection coil and a fixed amount of current applied to the focus coil, both as described below. This causes the Y-axis scan to traverse a central image translating area of photocathode electrode 91.

CAMERA ELECTRONICS

Typical camera electronics used in the present electro-optical bar gaging system is shown in FIG. 3 as camera electronics 35. Details of camera electronics 35 may best be understood by referring to FIGS. 3 through 10. All electronic components therein are conventional solid-state devices and include TTL logic elements where logic symbols indicate or imply their use.

Figure 4:
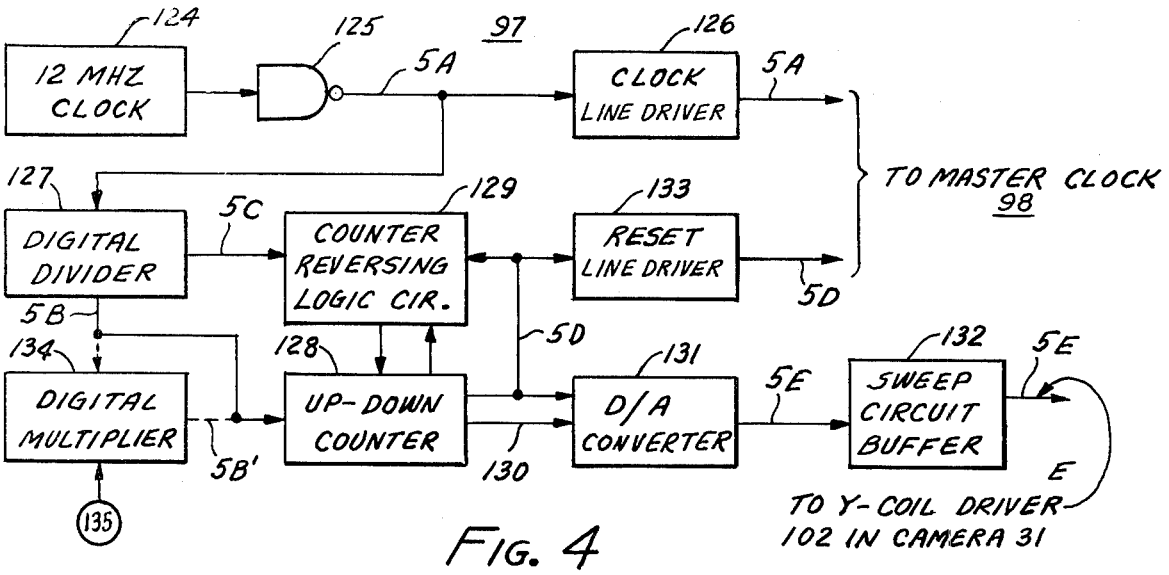
FIG. 4 is a block diagram of a bidirectional sweep generator used in the camera electronics shown in FIG. 3.
Figure 5:
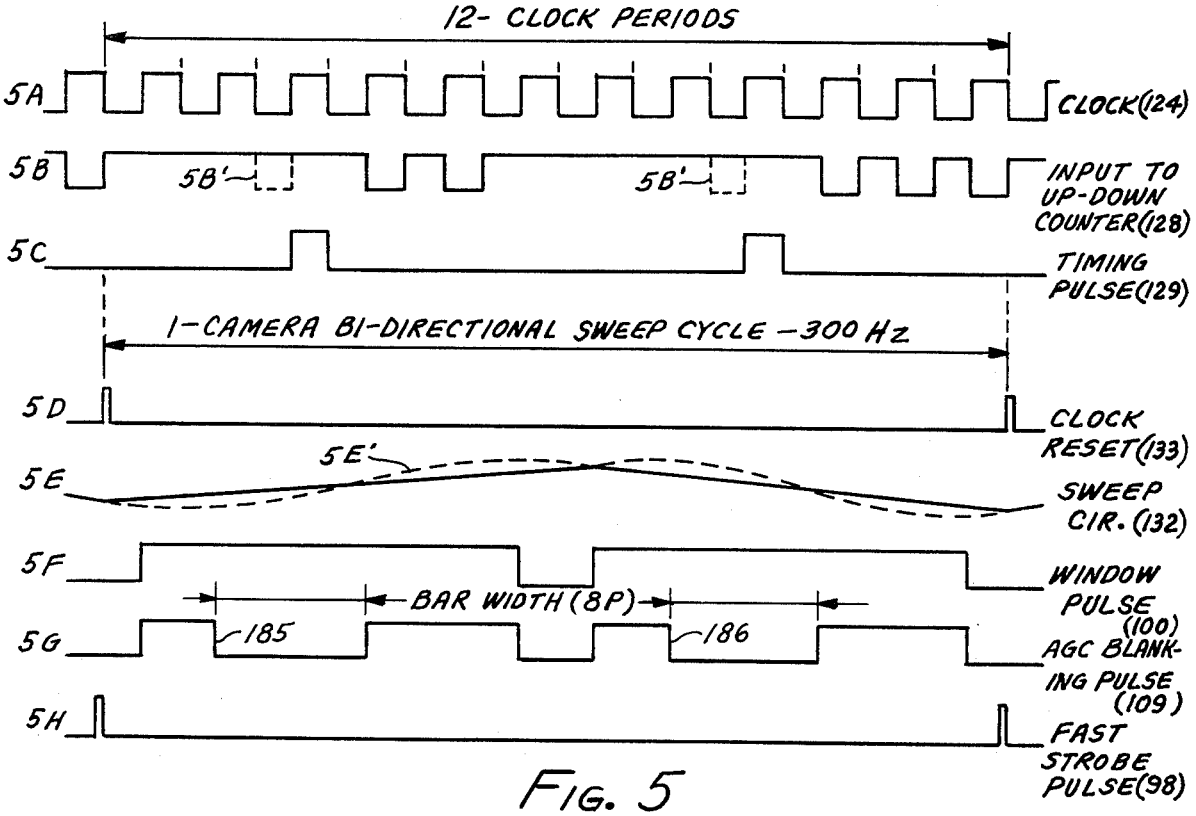
FIG. 5 is a timing diagram of pulses generated by the bidirectional sweep generator, master clock, window pulse generator, and AGC blanking circuits shown in the camera electronics of FIG. 3.

Generally, FIG. 3 shows bidirectional sweep generator 97 which is shown in FIGS. 4 and 5. It includes a 12 MHz. crystal oscillator that provides a train of basic square wave clock pulses 5A for the entire electro-optical bar gaging system. Except for actual measurement of processed bar pulses, all digital operations are synchronized with clock pulse 5A in addition to bidirectional sweep signal 5E and sweep reset pulse 5D, the latter two being generated in sweep circuitry at approximately 300 Hz. Clock pulse 5A and bidirectional sweep signal 5E are synchronized by sweep reset pulse 5D every sweep cycle so that sweep signal 5E may be divided for any purpose by using the appropriate submultiple of clock pulse 5A. Clock pulse 5A is used for actual measurements, while pulses for other bar gaging system requirements are derived by dividing clock pulse 5A down all the way to the frequency of bidirectional sweep signal 5E. It should be noted that the absolute frequency value of clock pulse 5A and bidirectional sweep signal 5E is not critical because the bar gaging system is calibrated by actually placing standard size bars in each camera's field-of-view. However, sweep stability and sweep linearity are highly critical, since they directly affect the bar gaging system accuracy.

Master clock 98 shown in FIG. 3 receives a train of the 12 MHz. clock pulse 5A and the 300 Hz. sweep reset pulses 5D from bidirectional sweep generator 97. Master clock 98 includes buffers, digital counter, divider and logic circuits to supply all synchronized pulses used throughout camera electronics 35 for timing and measuring purposes. These include buffered 12 MHz. clock pulses 5A, buffered 300 Hz. sweep reset pulses 5D. Additional pulses generated within are a 300 Hz. fast strobe pulse 5H of short duration and a data ready pulse similar to pulse 5H but longer in duration. The data ready pulse is outputed on wire 99 and the other pulses carry their same identity to other circuits shown in FIG. 3.

Window generator 100 receives the 12 MHz. clock pulse 5A from master clock 98 and, by means of gates and logic circuitry, generates window pulse 5F once every half of each bidirectional sweep cycle as shown in timing diagram FIG. 5. An inverted window pulse $\overline{5F}$ is also generated. Both window pulses 5F, $\overline{5F}$ are fed to other circuits described below. The width and timing of window pulses 5F, $\overline{5F}$ are determined by a control pulse on wire 101 fed from computer 27 during program GAGEIN described below. Briefly, the width of window pulses 5F, $\overline{5F}$ is related to the time required for sweep signal 5E to sweep only the photocathode electrode 91, this being only a major portion of each up or down half of an entire 300 Hz. sweep cycle. For example, if the camera field-of-view is three inches and lens is four inches, as they are herein, then the 3 inch field-of-view is imaged down centrally to cover the entire face of photocathode electrode 91. Over-scanning of photocathode electrode 91 results in each up and down half of bidirectional sweep cycle 5E. This over-scanning is equally divided into two time intervals at the beginning and ending of each up and down half of bidirectional sweep cycle 5E. Thus, the sum of the durations of window pulse 5F (about 75%) and the overscan (about 25%) equal the direction of each up and down half of bidirectional sweep cycle 5E. As an alternative arrangement, window pulse width may be established manually by selective gating means not shown to replace the computer 27 control signal on wire 101.

Still referring to FIG. 3, bidirectional sweep signal 5E is fed from bidirectional sweep generator 97 to Y-coil deflection driver 102 and into the vertical or Y-deflection coil in coil assembly 93. Constant current from focus coil current source 103 is fed to the focus coil in coil assembly 93. The magnitude of focus current is adjusted to focus all electrons emitted from each point on the photocathode surface 91 to a corresponding single point in the plane of the electron aperture 92.

In summarizing the image dissector tube 90 scanning effected by coil assembly 93, only single-scan Y-axis, or vertical, bidirectional scanning is present at any time, this occurring continuously as an up and down sweep with no blanking.

As bar shadow 81 is scanned over the camera field-of-view, output current from image dissector tube 90 drops sharply as bar shadow 81 is met, then rises again when the bar shadow is past. This current change, together with electrical noise from the mill environment, is converted to voltage, amplified in a preamplifier not shown in FIG. 3 and is the raw camera signal output from camera head 31 and appears on wire 34. That is, the raw camera signal at this point consists of a not too well defined bar pulse mixed with noise.

Image dissector tube 90 in camera head 31, operates in a self-balancing measuring loop 107 together with camera pulse processor 108, photomultiplier (P.M.) AGC circuit 109 which produces a variable control voltage on wire 110, and a voltage-controlled high voltage source 111 for P.M. section of tube 90. The drift section of tube 90 is also fed from a separate but stable drift section high voltage source 112.

Figure 6:
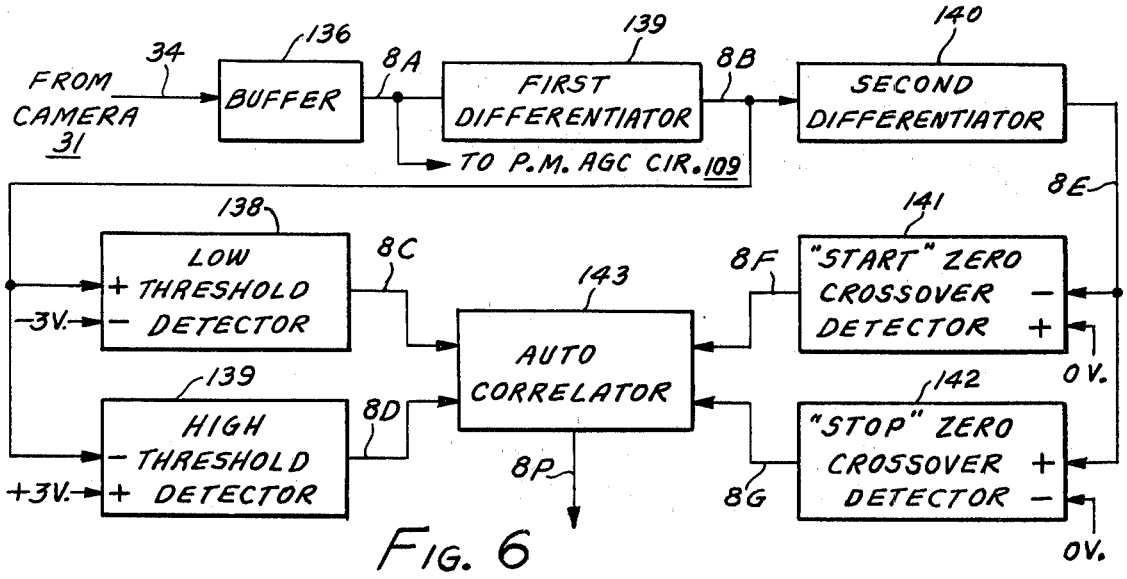
FIG. 6 is a block diagram of the camera pulse processor used in the camera electronics shown in FIG. 3.
Figure 7:
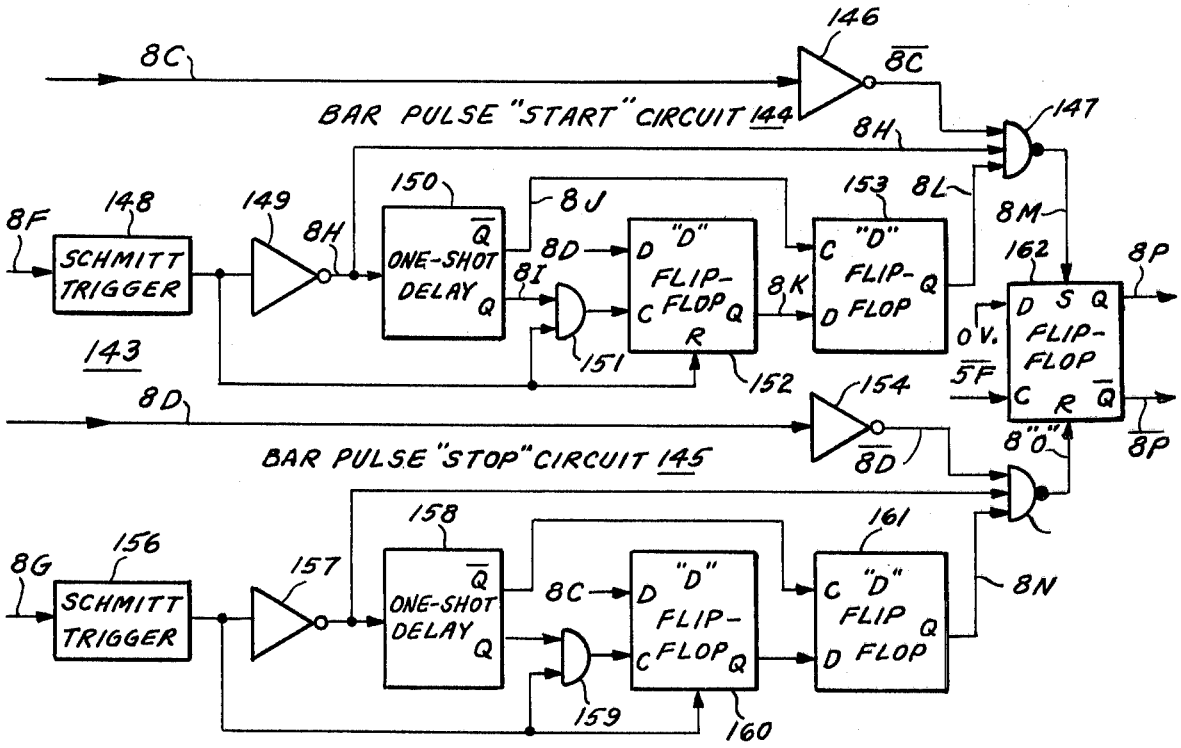
FIG. 7 is a block diagram of an autocorrelator used in the camera pulse processor shown in FIG. 6.

Camera pulse processor 108 is shown in FIGS. 6 and 7 with FIG. 8 illustrating the processor timing pulses. Included are a buffer, double differentiators, level detectors, zero-crossing detectors and an autocorrelator to remove noise from the raw camera signal and from differentiators. Signals so treated are combined with inverted window pulse $\overline{5F}$ in processor logic to ensure that only bar pulses of proper amplitude and occurring at the correct time, will be passed outward for measurement purposes. This also prevents passage of bar pulses when the window is not open. Camera pulse processor 108 produces a buffered camera signal 8A and precision square wave bar pulses 8P, $\overline{8P}$ generated by an internal flip-flop. Bar pulse width varies proportional to bar shadow 81 and therefore proportional to bar dimension between bar edges 82 and 83.

Figure 9:
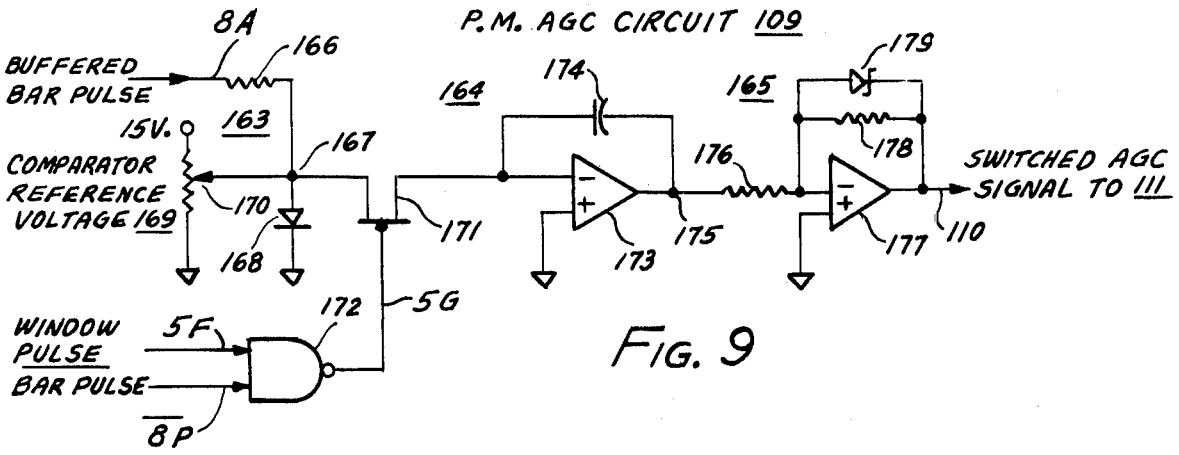
FIG. 9 is a circuit diagram of a P.M. AGC circuit shown in a camera self-balancing measuring loop incorporated in the camera electronics shown in FIG. 3.

P.M. AGC circuit 109, which is shown in FIG. 9 and described below, receives buffered camera signal 8A and includes a comparator, a switched-integrator and an amplifier for producing a switched variable control voltage on wire 110. This control voltage is fed to P.M. section high voltage source 111 for the purpose of varying the gain of image dissector tube 90. The comparator establishes a reference gain level and an internal logic circuit generates an AGC blanking pulse 5G by combining window pulse 5F with inverted bar pulse $\overline{8P}$. The AGC blanking pulse effectively defines the time intervals when the camera signal should be sampled.

Action of the self-balancing measuring loop 107 will now be described. When there is no bar 10 in the gaging system, only light from box 30 is imaged on photocathode electrode 91. This causes the P.M. section in image dissector tube 90 to generate a current to flow on wire 34 which is proportional to the intensity of light from box 30. The gain of P.M. section in tube 90 is adjusted to a high level initially by the effective level of AGC control voltage produced by circuit 109. As light intensity deteriorates, or the image dissector tube 90 ages, AGC circuit 109 automatically compensates for this by adjusting the level of P.M. section high voltage from source 111 to vary the gain of the P.M. section of tube 90 and thereby maintain a constant amplitude of the camera signal.

When bar 10 is imposed in the path of light from box 30, AGC circuit 109 also functions to maintain a constant amplitude in the output from image dissector tube 90. Self-balancing measuring loop 107 thereby permits operation of image dissector tube 90 at a high sensitivity level while maintaining a reasonably high signal-to-noise ratio which is desirable for effective raw camera pulse processing.

Still referring to FIG. 3, precision bar pulses 8P, clock pulses 5A, clock reset pulses 5D and fast strobe pulses 5H are fed to display timing 113. Logic circuits therein are arranged to count clock pulses 5A for the duration of each of two bar pulses 8P occurring during a bidirectional sweep cycle, then dividing by two. Counting is synchronized by clock reset pulse 5D which occurs at the bottom of each bidirectional sweep signal 5E. Logic circuits are strobed by fast strobe pulse 5H in preparation for a binary bar size signal being outputed on wire 114 for display purposes. In order to avoid display flicker, the binary bar size signals are averaged over a predetermined number of bidirectional sweeps, such as 4, 32, 512 sweeps, by means not shown.

Binary bar size signals are fed over wire 114 to digital indicator 115. This device includes integrated counter-decoder-display modules calibrated to display in decimal digits the uncorrected size of bar 10 obtained anywhere in the camera field-of-view. The term uncorrected bar size is applied to bar dimensions at this part of the bar gaging system because no correction for optical and/or electronic nonlinearities, bar temperature and bar composition has been made.

Computer 27 does make corrections to the uncorrected bar size signals and feeds a corrected binary bar size signal over wire 116 to corrected bar size digital indicator 117. This digital indicator is structured the same as digital indicator 115. Both bar size indicators 115, 117 have visual displays adapted to be synchronized and updated every 512 sweep under control of clock reset pulses 5D and fast strobe pulses 5H. It is to be noted that the difference between readings on bar size indicators 115, 117 signifies to a bar gage operator, and to a rolling mill operator, that (a) the correction features of the bar gaging system are working as required, and (b) that the rolling mill is rolling aim size product.

Computer correction of bar pulses 8P is based upon accurately determining not only bar size but also bar centerline position in the camera field-of-view with respect to the optical axis of camera head 31. To do this, bar pulses 8P, clock pulses 5A, clock reset pulses 5D and fast strobe pulses are fed to bar size and position accumulator 118 which is illustrated in block diagram FIG. 10 and the timing of pulses is shown in FIG. 5.

Two separate counter and latch circuits, each under control of a common control gate, provide binary bar size output signals on wire 119 and binary bar centerline position output signals on wire 120. The binary bar size signals on wire 119 are developed similarly to the uncorrected bar size signals associated with display timing circuits 113 described above. The binary bar position signals permit corrections to be made of the bar size signals to an accuracy of 1 part in 256 of the camera field-of-view.

Transfer of all data between the computer 27 and other parts of the bar gaging system is carried out by gagecomputer data transfer logic circuit 121. Logic circuit 121 receives a command signal over wire 122 which is indicative of computer 27 being of such state as to permit data transfer. Command signal 122 is logically combined with the "data ready" pulse on wire 99, which is generated by master clock 98 as described above. Their combined presence causes logic circuit 121 to generate a "request to send" signal on wire 123 and synchronize the timing of the gaging system with computer 27.

BIDIRECTIONAL SWEEP GENERATOR

Reference will now to made to bidirectional sweep generator 97 shown in FIG. 4 block diagram and FIG. 5 timing diagram. In order to make bar size measurements to a system accuracy of quarter commercial tolerance in a 3 inch field-of-view, the bidirectional sweep of the Y-axis in image dissector tube 90 must be extremely linear and repeatable. Conventional analog sweep circuits are generally difficult to design and maintain to the level of linearity required herein. But if a sacrifice in system accuracy is acceptable for some gaging systems, then analog sweep circuits may be considered. However, to meet the high accuracy requirements of the present gaging system, the bidirectional sweep of the Y-axis is generated by digital means with a crystal oscillator for a time base, digital counters, and a fourteen-bit digital-to-analog converter that develops the actual bidirectional sweep waveform 5E. Digital provisions are made to modify sweep waveform 5E as described below.

The time base provided is a highly stable 12 MHz. crystal clock oscillator 124 having a square wave output. Buffer 125 prevents nonuniform loading of time base 124 during sweep operations and feeds a train of clock pulses 5A to differential line drive 126. Output from driver 126 is fed as clock pulse 5A to master clock 98 in camera electronics 35. Buffer 125 output also feeds clock pulses 5A to digital divider 127 which has counting and logic devices that generate waveforms 5B and 5C. Waveform 5B is an input to up-down counter 128, a 14-bit binary reversing counter. Waveform 5B is 5/12 of the basic clock frequency, or 5 MHz. Waveform 5C is a timing pulse fed to counter reversing logic circuit 129 and occurs twice in a 12 clock cycle period. Waveform 5B uses five pulse locations in a period of 12 clock cycles and waveform 5C uses two locations. This leaves five unused pulse locations of the 12 clock cycles in the bidirectional sweep period.

When the counter reversing logic circuit 129 senses that up-down counter 128 has reached a full count of all 1's, it gates a count-down enable signal back to counter 128. The timing of the count-down enable occurs at the first timing pulse 5C after the full count is reached. When counter 128 senses the count-down enable signal, it begins down counting on the next clock pulse 5B.

When the counter reversing logic circuit 129 senses all 0's in the counter 128, it generates a count-up enable signal on the next occurrence of timing pulse 5C. Counter 128 will begin counting up on the next clock pulse 5B.

Up-down counter 128 has a 14-bit binary output which is fed over wire 130 to 14-bit binary digital-to-analog converter 131. Digital-to-analog (D/A) converter 131 tracks counter 128 and produces an extremely linear analog bidirectional sweep signal 5E. This signal is buffered in sweep circuit buffer 132, to prevent overloading of D/A converter 131, and then fed as sweep signal 5E to Y-coil driver 102 in camera electronics 35.

When up-down counter 128 reaches the last down bit, it generates reset pulse 5D which resets logic circuit 129 and D/A converter 131. Differential line driver 133 feeds the reset signal 5D to master clock 98 in camera electronics 35.

As mentioned above, there are five unused pulse locations in a period of 12 clock cycles. These may be used to provide an accurate nonlinear modification to the extremely linear sweep signal 5E by incorporating digital multiplier 134 in series between digital divider 127 and updown counter 128 as shown by dotted lines in FIG. 4. Digital multiplier 134 will receive waveform 5B instead of updown counter 128 as shown by dotted lines in FIG. 4. Digital multiplier 134 will receive waveform 5B instead of updown counter 128 and by means of a suitable multiplier generate modified waveform 5B'. Up-down counter 128 will receive modified waveform 5B' and, together with the timing pulse 5C influence on the command signal, will alter the total up-count or total down-count depending on the specific value of the multiplier. This modification will still produce a triangle sweep with slightly curved sides as indicated by modified sweep signal 5E'.

The multiplier for digital multiplier 134 is fed over wire 135 and may originate at computer 27. Alternatively, the digital multiplier may be set by manual means not shown. Regardless of its source the multiplier may be used to make sweep corrections for overcoming optical and/or electronic errors for which no other correction provisions have been made herein.

CAMERA PULSE PROCESSOR

The camera pulse processor 108 is shown in FIG. 6, 7 block diagrams and FIG. 8 timing diagram. Camera pulse processor 108 converts the raw camera pulse on lead 34 into a precise bar output pulse on lead 8P that has a width with well-defined edges that accurately represents the dimensional relationship between bar edges 82 and 83. Because of the differentiator, autocorrelator and other design features described below, camera pulse processor 108 is very well suited to process the raw camera pulses at the camera scanning rate of up to about 300 Hz., yet eliminate the effects of camera signal and differentiator noises.

Turning now to FIG. 6, camera pulse processor 108 is shown in block diagram form where alpha designations refer to FIG. 8 waveforms. The raw camera signal from lead 34 is buffered and amplified by buffer 136 to produce signal 8A. The 8A signal is differentiated by first differentiator 137 which has an output 88. The first differential signal 8B is fed to low and high threshold detectors 138, 139 which have respective outputs 8C and 8D. Threshold detectors 138, 139 produce output signals when their plus (+) input has a lower voltage than their minus (−) input.

The first differentiated signal 8B is differentiated again in second differentiator 140 to produce output 8E. The second differentiated signal 8E is fed to start and stop zero cross-over detectors 141, 142. These detectors are set up to trigger on positive and negative zero crossing transitions greater than 1 mv., thereby producing bar pulse start zero and stop zero outputs 8F and 8G, respectively. The bar pulse start zero and stop zero outputs 8F and 8G, together with low and high threshold signals 8C and 8D, are fed to fixed-delay autocorrelator 143. Bar pulse start zero and stop zero signals 8F and 8G are processed internally in respective autocorrelator circuits as will be described below. Low and high threshold signals 8C and 8D define narrow windows during which the bar pulse start and stop signals 8M and 8"O" are triggered, thereby establishing precise timing for the leading and trailing edges of bar output pulse 8P.

As mentioned above, electronic camera 31 signal on lead 34 may also contain electrical noise. This may be high frequency, low amplitude noise which is frequently coupled magnetically into the electronic camera signal from high-current, SCR-fired, mill drive motor controllers located near electronic camera 31. Without fixed-delay autocorrelator 143, this noise will cause false triggering of bar output pulse 8P. For example, when a transition of camera signal 8A produces a first differentiated voltage 8B lower than a −3 volt threshold of detector 138, a low threshold signal 8C would be enabled which will allow start zero crossing detector 141 to generate a bar output pulse start trigger signal. Since the gain of differentiators 137 and 140 increases with input frequency, a low-amplitude, high-frequency noise spike may produce a first differentiator 137 output signal 8B lower than the −3 volt threshold of detector 138. This is precisely what will happen in rolling mill environments without enhancement of bar pulse generating circuitry.

For this reason, the fixed-delay autocorrelator 143 included in raw camera pulse processor 108 actually includes separate autocorrelator bar pulse start and stop circuits 144 and 145, respectively, as shown in FIG. 7. Bar pulse start and stop circuits 144 and 145 are provided to discriminate between second differentiated signals 8E generated by high frequency noise from those generated by valid bar pulse signals. During the falling edge of camera signal 8A, the second differentiated signal 8E rises to a positive voltage for about 10 microseconds before swinging to a negative voltage. For illustrative reasons, this detail is not shown to scale in FIG. 8 signal 8E waveform. Zero crossing detection of the second differentiated signal 8E by detectors 141 and 142 is the trigger point for the start and stop bar pulses of signals 8M and 8"O", thereby establishing the leading and trailing edges of bar output pulse 8P.

Autocorrelator bar start and stop circuits 144 and 145 take advantage of the respective 10 microsecond rise and fall period of second differentiated signal 8E. This is done by generating autocorrelator enable start and stop signals 8L and 8N as described below. Autocorrelator start enable signal 8L is generated when second differentiated signal 8E is continuously positive for at least one-half of this 10 microsecond period before swinging negative. Similarly, autocorrelator stop enable signal 8N is generated when second differentiated signal 8E is continuously negative for at least one-half of the 10 microsecond period before swinging positive.

Autocorrelator start and stop enable signals 8L and 8N are logically "anded" in circuits 144 and 145 with respective low threshold signals 8C and 8D and bar pulse start and stop zero crossing signals 8F and 8G to generate bar pulse start and stop signals 8M and 8"O". These signals cause the precise generation of bar output pulse 8P. It will now be apparent that high frequency noise which causes respective positive and negative excursions of the second differentiated signal 8E of less than 5 microseconds duration will not generate autocorrelator enable start and stop signals 8L and 8N, thus preventing triggering of bar output pulse 8P.

Still referring to FIG. 7, operation of autocorrelator bar pulse start circuit 144 will now be described. Operation of autocorrelator bar pulse stop circuit 145 is identical to circuit 144 with the exception that it responds to a second differentiated signal 8E which is continuously negative for 10 microseconds before swinging positive. Both circuits 144 and 145 employ conventional logic devices.

Low threshold signal 8C is inverted in amplifier 146 and fed to one of three inputs of NAND gate 147, the latter providing the bar pulse start signal 8M under proper logic conditions.

Bar pulse start zero crossing signal 8F is conditioned in Schmitt trigger 148 and inverted in amplifier 149, thereby producing trigger signal 8H which is fed to NAND gate 147 and one-shot delay device 150. A negative going transition of signal 8H triggers one-shot delay device 150 which produces a 5 microsecond logic "1" pulse 8I at Q output, and a 5 microsecond logic "0" pulse 8J at $\overline{Q}$ output. Pulse 8I is fed to one of two inputs to AND gate 151. Schmitt trigger 148 output is also fed to the other input of AND gate 151 as well as to reset input of flip-flop device 152. Pulse 8J is fed to the clock input of flip-flop device 153. The high threshold signal 8D is wired to the data input of flip-flop 152 to enable the autocorrelator start circuit 144 during the falling edge of camera signal 8A and disable this circuit during the rising edge of signal 8A.

If signal 8H is going negative, the input to inverter 149 is going positive. This positive going action removes the reset condition on flip-flop 152 and puts a logic "1" on one input of AND gate 151. Gate 151 will now pass pulse 8I to the clock input of flip-flop 152, thus forcing a logic "1" pulse 8K at Q output. After a 5 microsecond delay, one-shot delay 150 will time out, thereby causing output $\overline{Q}$ to change state and go to a logic "1" pulse 8J. This action also clocks the input of flip-flop device 153 which has its data input fed by signal 8K from the Q output flip-flop device 152.

If signal 8K is a logic "1", flip-flop 153 output Q will be set, thereby producing start enable signal 8L. Signal 8L, which was generated from signal 8H, is logically combined with signals 8H and $\overline{8C}$, the inverted low threshold signal, in NAND gate 147 to produce the bar pulse start signal 8M. Thus, it will now be readily recognizable that a bar pulse signal is delayed, then combined with itself to perform a fixed-delay autocorrelation function.

If during the 5 microsecond period controlled by one-shot delay device 150, the output of Schmitt trigger 148 goes low, indicating that the second differentiated signal 8E is too narrow to be a valid bar signal, the reset of flip-flop 152 goes low and forces signal 8K to a logic "0". When one-shot delay device 150 times out after 5 microseconds, signal 8J will clock flip-flop 153 with its data input in a low state. This will force the Q output of flip-flop 153 to a logic 37 0" and prevents any further processing of the bar signal.

One-shot delay device 150 is retriggerable so that it may accommodate consecutive triggering pulses 8H. If multiple trigger pulses having a short duration of less than 5 microseconds trigger one-shot delay device 150, Q output signal 8I will stay high for all pulses and finally time-out 5 microseconds after the last triggering pulse. AND gate 151 allows flip-flop 152 to re-clock itself on each pulse. Since the output of one-shot delay device 150 stays high continuously during these multiple triggering pulses, the combining of signal 8I with the Schmitt triggering pulse in AND gate 151 guarantees that the clock line on flip-flop 152 will undergo a logic transition from "0" to "1" for each triggering pulse.

As noted above, the bar pulse stop circuit 145 was identical with circuit 144, the exception being that stop circuit 145 is triggered by a continuous negative going second differentiated signal 8E before swing positive. For this reason, it will be apparent to those skilled in the art that inverter 154, NAND gate 155, Schmitt trigger 156, inverter 157, one-shot delay 158, AND gate 159, flip-flop 160, and flip-flop 161 devices have construction and operating features the same as their counterpart in circuit 144. Therefore, it is felt an explanation of these devices is unnecessary to show how NAND gate 155 produces the bar pulse stop signal 11"0".

Having eliminated both the electrical noise in the raw camera bar pulse signal and the noise produced by differentiators 137 and 140, the bar pulse start and stop signals 8M and 8"O" produced in respective circuits 144 and 145 now precisely define the timing of bar pulse leading and trailing edges in relation to bar edges 82 and 83. Therefore, signals 8M and 8"O" are fed respectively to the set and reset inputs of flip-flop device 162. An inverted window pulse $\overline{5F}$ shown in FIG. 5 and fed from window generator 100 is fed to the clock input of flip-flop device 162. The data input of flip-flop 162 is tied to 0 volts. This will enable device 162 to produce the bar output pulse only during the presence of a window pulse 5F.

During bar gaging operations the Q output of device 162 provides a precise bar output pulse 8P whose leading and trailing edges are free of noise and accurately define the lateral dimension of bar 10.

P.M. AGC CIRCUIT

The AGC circuit 109 for the photomultiplier (P.M) section of image dissector tube 90 is shown in FIG. 9. P.M. AGC circuit 109, which is an essential portion of self-balancing measuring loop 107, includes comparator 163, switched integrator 164 and driver amplifier 165. Amplifier 165 drives P.M. section high voltage source 111 with a switched variable control voltage by way of wire 110. The switched variable control voltage acts as an automatic gain control for tube 90. This is done by varying P.M. section high voltage source 111 to maintain anode current in tube 90 at a constant reference value.

Buffered camera signal 8A is applied to one input of comparator 163 through summing resistor 166 to summing junction 167. Summing junction 167 is limited to positive-going inputs by diode 168. A comparator reference voltage from source 169 is adjusted at potentiometer slider 170 for the purpose of offsetting the bar pulse and establishing a nominal value of the switched control signal that will ultimately set high voltage source 111 at a nominal gain-producing value.

The buffered and offset camera signal at summing junction 167 is to electronic switch 171 in switched integrator 164. The window pulse 5F and the inverted bar pulse $\overline{8P}$ are logically combined in AND gate 172 to produce AGC blanking pulse 5G shown in FIG. 5. When a window pulse is present and a bar pulse is absent, the AGC blanking pulse 5G causes electronic switch 171 to conduct current to integrator amplifier 173 and to charge integrating capacitor 174. When both window pulse 5F and bar pulse 8P are present, electronic switch 171 opens and allows integrator output at junction 175 to maintain the nominal value input to driver amplifier 165.

Driver amplifier 165 consists of summing resistor 176 connected at one end to integrator output junction 175 and the other end to the input of operational amplifier 177. Feedback resistor 178 controls the gain of driver amplifier 165. Zener diode 179 limits the gain of driver amplifier 165 so as not to produce too high a switched control voltage on wire 110 that would overdrive high voltage power supply 111. In summary, when an AGC blanking pulse 5G is absent, the buffered camera signal 8A is conducted through AGC circuit 109 and varies the P.M. section high voltage supply 111. During the presence of an AGC blanking pulse, 8A is inhibited and the output of P.M. AGC circuit 109 maintained at a constant reference value determined by the charge on capacitor 174 in integrator 164.

BAR SIZE AND POSITION ACCUMULATOR

Figure 10:
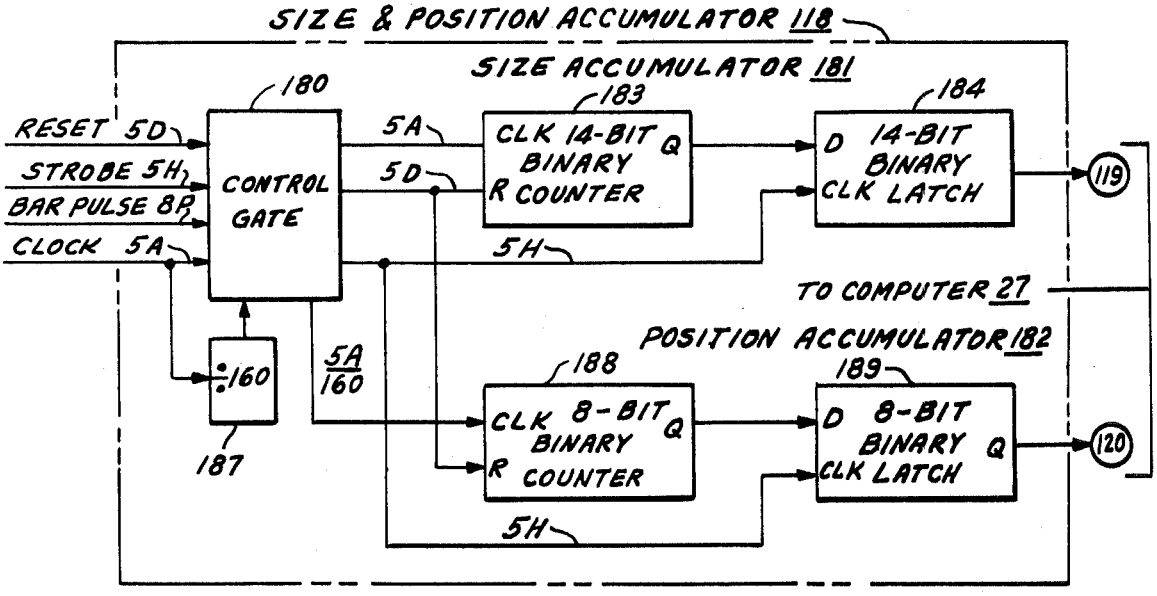
FIG. 10 is a block diagram of a bar size and position accumulator used in the camera electronics shown in FIG. 3.

The size and position accumulator 118 is shown in FIG. 10 with reference being made to FIGS. 5, 8 timing diagrams. In the present bar gaging system, uncorrected digital bar size and bar position data fed to computer 27 are developed similar to, but separately and independently from, uncorrected digital bar size data displayed on indicator 115. Accumulator 118 is provided with control gate 180 which assimilates bar pulse 8P, clock pulse 5A, clock reset pulse 5D and fast strobe pulse 5H in bar size accumulator circuit 181 and bar position accumulator circuit 182. Circuit 182 determines the bar centerline anywhere in the camera field-of-view. Both circuits 181, 182 are synchronized by clock reset pulse 5D and both are strobed by fast strobe pulse 5H every complete sweep cycle.

Control gate 180 detects the leading and trailing edges of each bar pulse 8P and divides by two the number of clock pulses 5A occurring during the two bar pulses present during the up and down halves of the sweep cycle. Control gate 180 directs these clock pulses to the clock input of 14-bit binary counter 183 in bar size circuit 181 where a count of two bar pulses divided by two is registered. At the end of a first sweep cycle this size pulse count in counter 183 is transferred into the data input of 14-bit binary latch 184, presuming a previous application of the fast strobe pulse 5H has been applied to the latch's clock input. At the beginning of the second cycle, counter 183 is cleared by clock reset pulse 5D and is ready to receive a new pulse count.

Fourteen-bit digital data, representing uncorrected bar size between bar edges 82 and 83, from the first sweep cycle, is stored in latch 184 for a second sweep cycle. During the second sweep cycle this data is transferred over cable 119 to computer 27 for correction under computer program CMPNST described below.

At the end of the second sweep cycle, counter 183 data is strobed into latch 184 by pulse 5H, thus repeating the cycle. The counting of bar size pulses is always one sweep cycle ahead of the latched bar size data in bar size accumulator circuit 181.

Control gate 180 also detects the first 8P bar pulse edge at 185 during the up-half of a sweep cycle and the first 8P bar pulse edge at 186 during the down-half of the same sweep cycle is shown in waveform 5G in FIG. 5. Control gate 180 determines the sweep time between pulse 8P leading edges 185 and 186 and divides this time by two, thereby establishing what will be referred to as the bar centerline position sweep time. In addition, control gate 180 also includes a bar position time base developed by dividing the train of 12 MHz. clock pulses 5A by a factor of 160 in divider 187, thereby generating 5A/160 clock pulses. 5A/160 clock pulses are directed to the clock input of 8-bit binary counter 188 in bar position accumulator 182 for the duration of the bar centerline position sweep time. The count registered in counter 188 represents centerline position of bar 10 located anywhere in the camera field-of-view. This bar centerline position was determined totally independently of the bar size measurement made in size accumulator 181 or elsewhere.

At the end of a first sweep cycle the bar centerline position count in counter 188 is transferred into the data input of 8-bit binary latch 189, presuming a previous application of fast strobe pulse 5H has been applied to the latch's clock input. At the beginning of the second cycle, counter 188 is cleared by clock pulse 5D and is ready to receive a new bar centerline position pulse count.

Eight-bit data representing bar centerline position in the camera field-of-view is stored in latch 189 for a second sweep cycle. During the second sweep cycle this data is transferred over cable 120 to computer 27 for use in making optical error corrections to the bar size data in accumulator 181 under computer program CMPNST described below. At the end of the second sweep cycle, counter 188 data is strobed into latch 189 by pulse 5H, thus repeating the cycle. Counting of bar centerline position pulses is always one sweep cycle ahead of the latched data in bar position accumulator 182.

Bar position accumulator 182 divides one-half of a sweep cycle into 256 increments at 0.016 inch per increment. The optical centerline of camera head 31 is at the 128th increment. The incremental total represents 4.096 inches of Y-axis sweep applied to the Y-axis deflection coil with a usable field-of-view of approximately three inches. The unusable field-of-view is 1.096 inches, the distance the Y-axis deflection coil sweeps off the top and bottom edges of photocathode electrode 91.

COMPUTER

Figure 11:
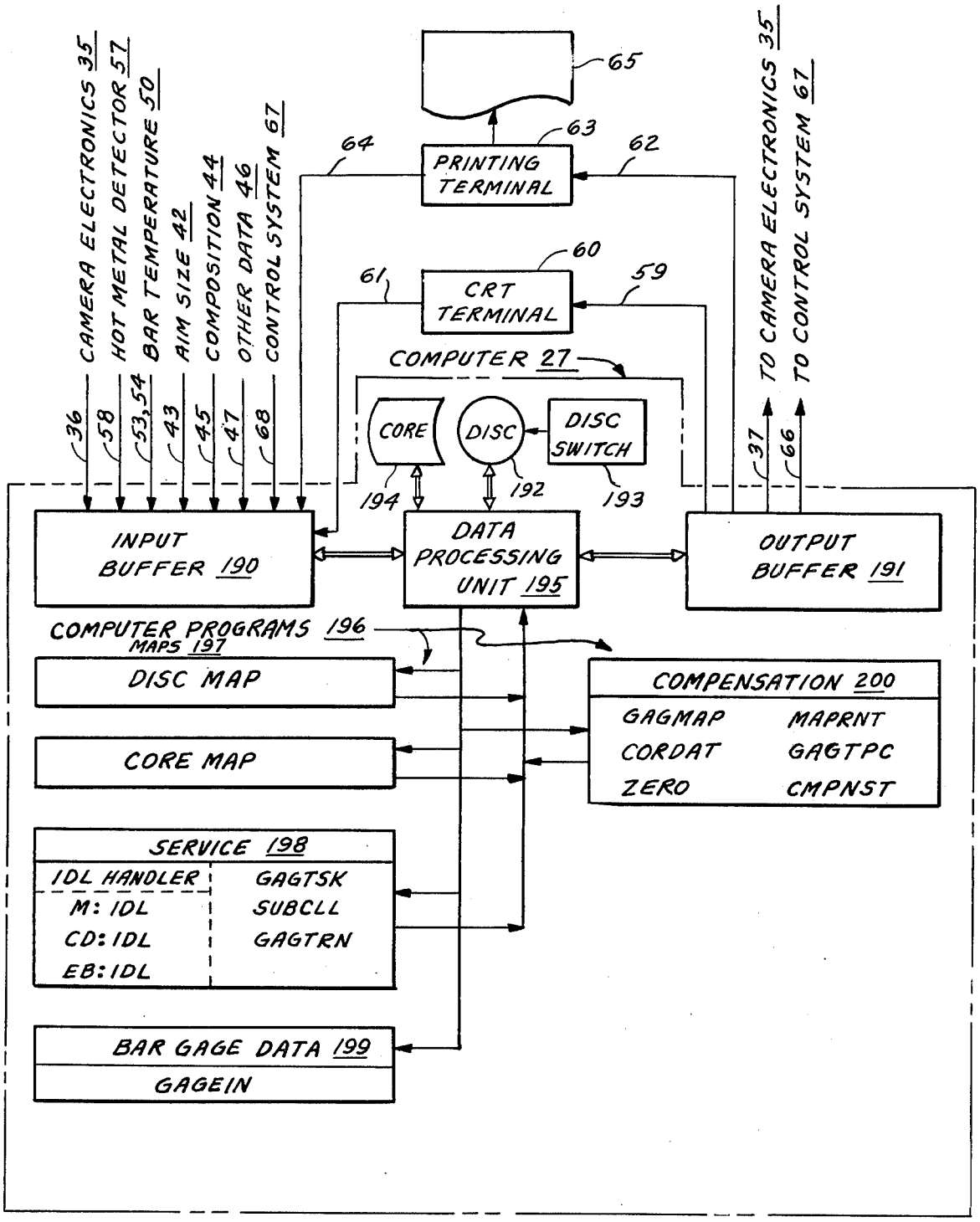
FIG. 11 is a block diagram of the computer shown in FIG. 1 and includes references to computer flow charts and printouts shown in FIGS. 12 to 26.

A block diagram of the electro-optical bar gaging system computer 27 is illustrated in FIG. 11. Computer 27 is a digital system programmed to perform the various functions described below. A commercially available mini-computer may be used, or if desired, computer 27 may be shared in overall rolling mill control computer installation. Computer 27 is exemplified herein as a Westinghouse Electric Co. model W-2500 with an operating system for accommodating various levels of tasks as noted below:

Computer 27 is provided with conventional main components including input buffer 190, output buffer 191, disc storage 192, disc switches 193, core storage 194, all communicating by various channels with data processing unit 195. Computer 27 operations are controlled sequentially according to off-line and on-line computer programs 196. These comprise: computer maps 197, service programs 198, bar gage data program 199 and compensation programs 200, all covered in FIGS. 12–26 described below.

All communications with the bar gaging system computer 27 from external sources are by way of input buffer 190 which includes means for converting input analog and digital signals to digital form. These includes signals fed by wires or cables into the computer as follows: camera electronics 35 on cable 36; hot metal detector 57 on wire 58; bar temperature 50 on cables 53, 54; bar aim size 42 on wire 43; bar composition 44 on wire 45; other data 46 on cable 47; control system 67 on cable 68; CRT terminal 60 on cable 61; and printing terminal 63 on cable 64.

All communications with bar gaging system computer 27 to external sources are by way of output buffer 191 which also includes means for converting output signals to digital and analog form. These include signals fed by wires or cables from the computer as follows: control system 67 on cable 66; and camera electronics 35 on cable 37.

Individual wires in signal cables have been used through the drawings and these have been cabled according to their source and function as described above.

CRT terminal 60 includes a keyboard for operator interaction with computer 27.

Printing terminal 63 includes a keyboard for operator interaction with computer 27. Terminal 63 computer printout 65 includes a display of bar diameter deviation, as well as tabular data in various figures listed below.

Generally, it is permissible for both terminals 60 and 63 to display the same data. All interactions from either keyboard are by way of program mnemonics listed, for example, in FIG. 18B.

Disc switches 193 include switches designated "switch 10" and "switch 12" in the programs below. These switches must be turned to "WRITE ENABLE" to update programs or data on the disc.

COMPUTER PROGRAMS

The following table lists flow charts of individual and groups of programs associated with computer programs 196 used herein.

| FIG. No. | Flow Chart Identification | Used Off-Line | Used On-Line |
|---|---|---|---|
| | MAPS (197) | | |
| 12 | DISC MAP | X | |
| 13 | CORE MAP | X | X |
| | Service Programs (198) | | |
| | IDL Handler | | |
| 14A–E | M:IDL | X | X |
| 15 | CD:IDL | X | X |
| 16 | EB:IDL | X | X |
| 17A,B | GAGTSK | X | |
| 18A,B | SUBCLL | X | |
| 19 | GAGTRN | X | |
| | Bar Gage Data Program (199) | | |
| 20A–B | GAGEIN | X | X |
| | Compensation Programs (200) | | |
| 21A–B | GAGMAP | X | |
| 22 | CORDAT | X | |
| 23 | ZERO | X | |
| 24A–B | MAPRNT | X | |
| 25 | GAGTPC | X | X |
| 26 | CMPNST | X | X |

MAPS (197)

Figure 12:
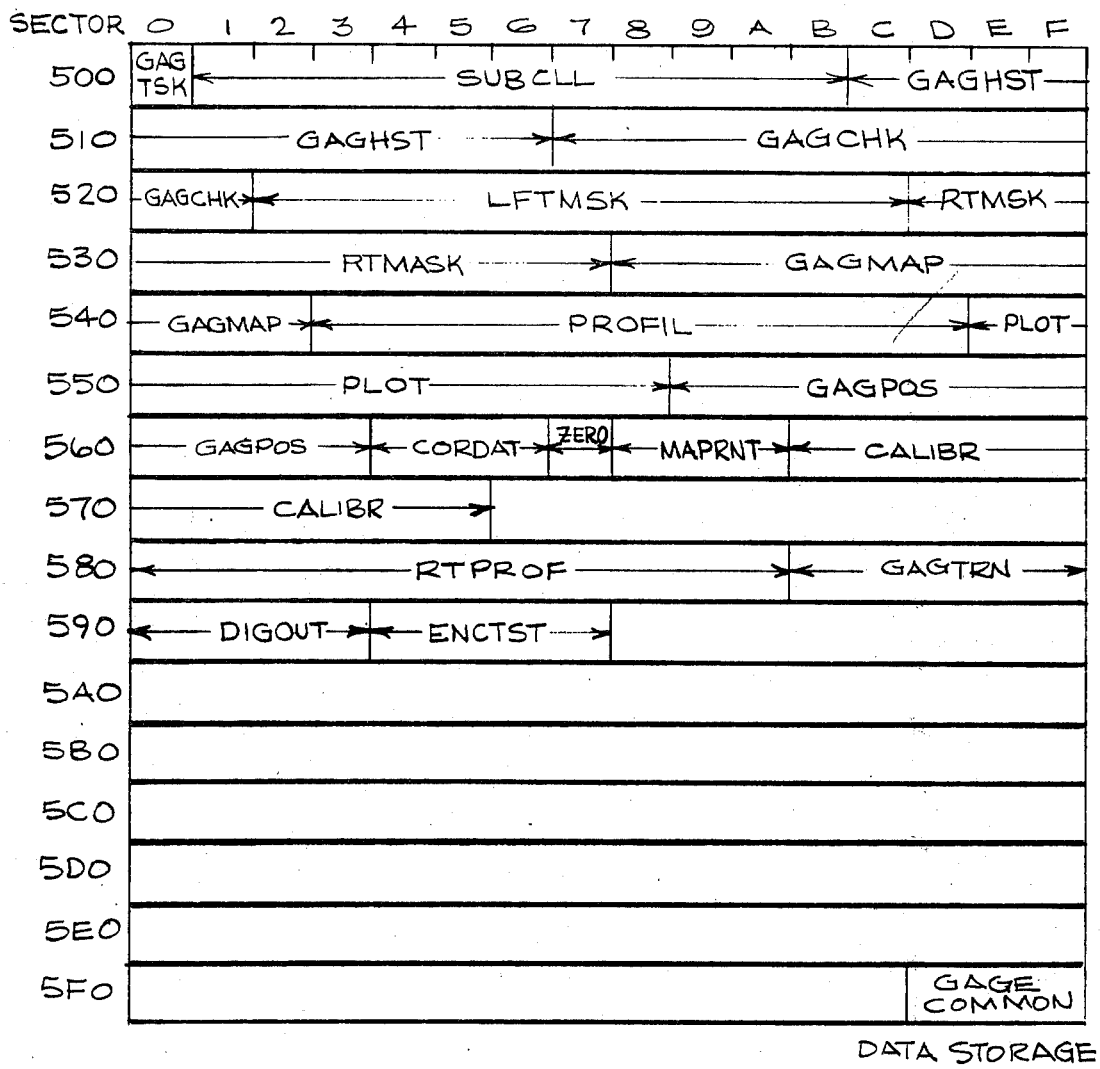
FIG. 12 is a computer DISC MAP.
Figure 14A:
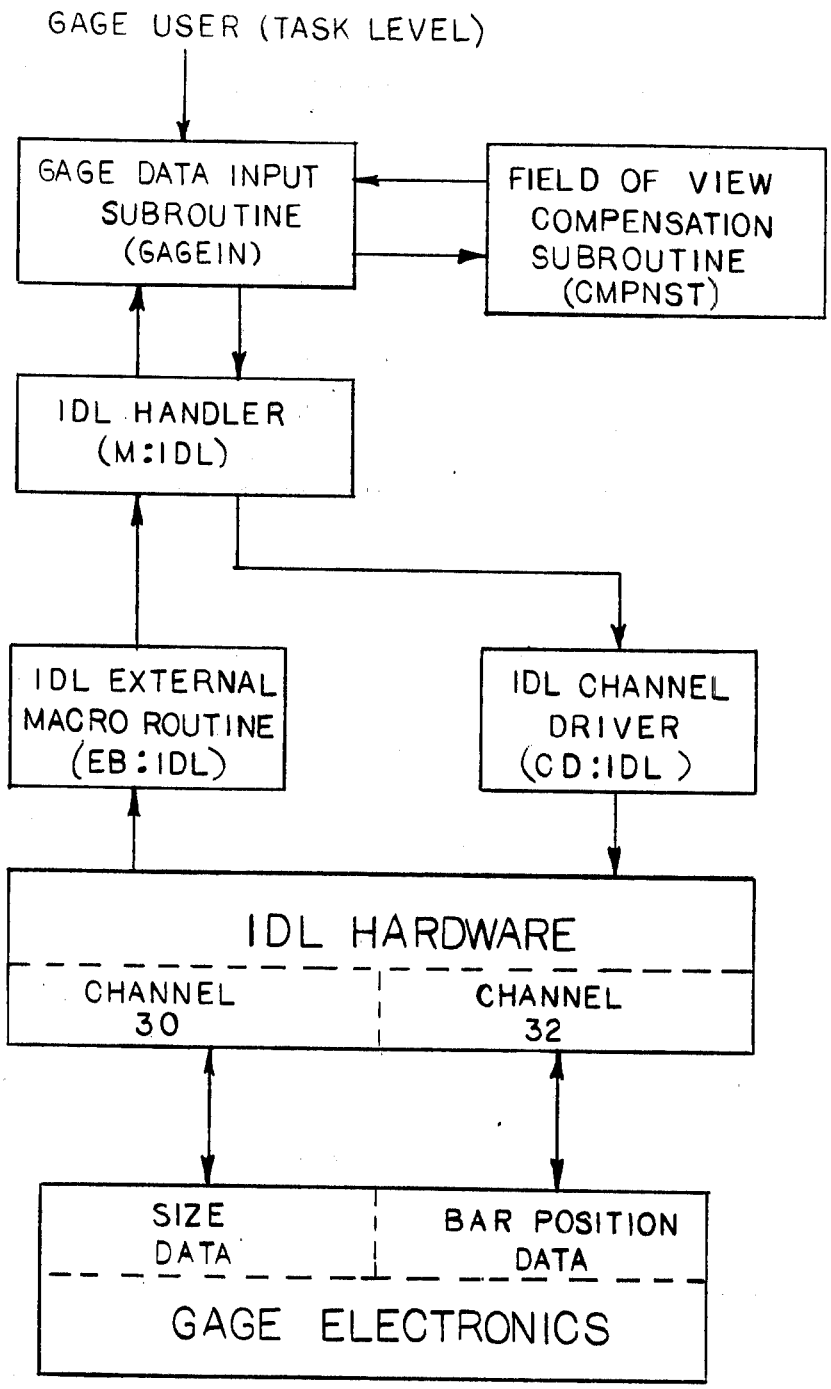
Figure 14B:
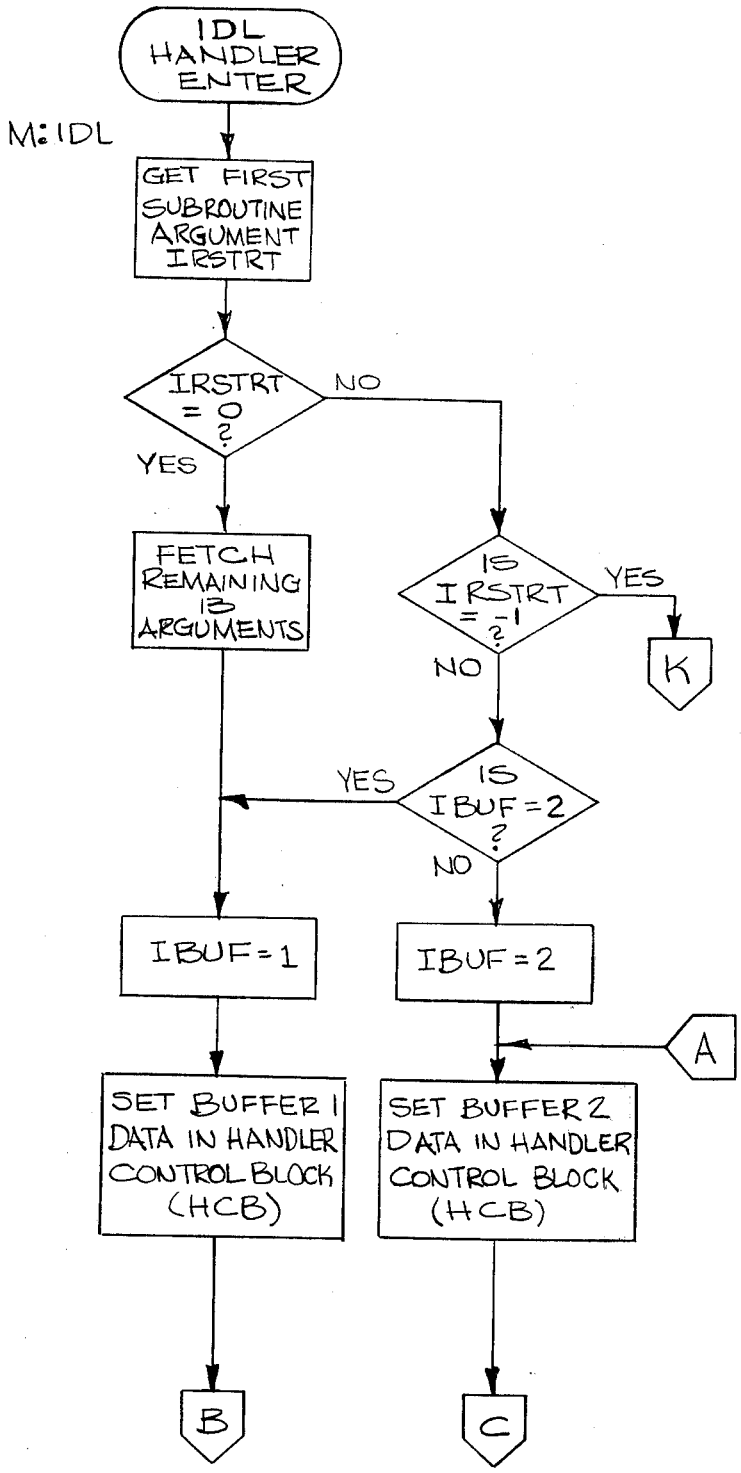
Figure 14C:
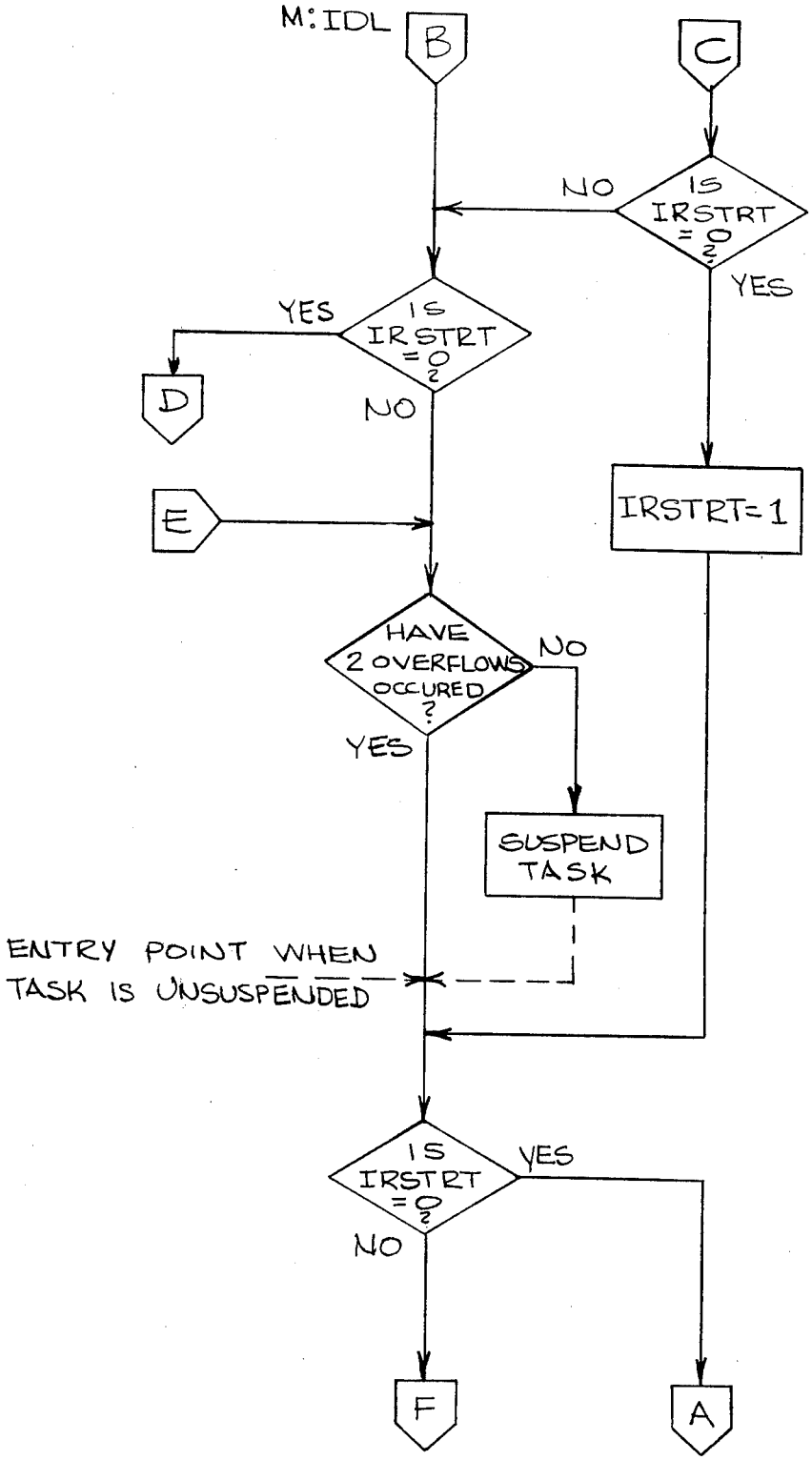
Figure 14D:
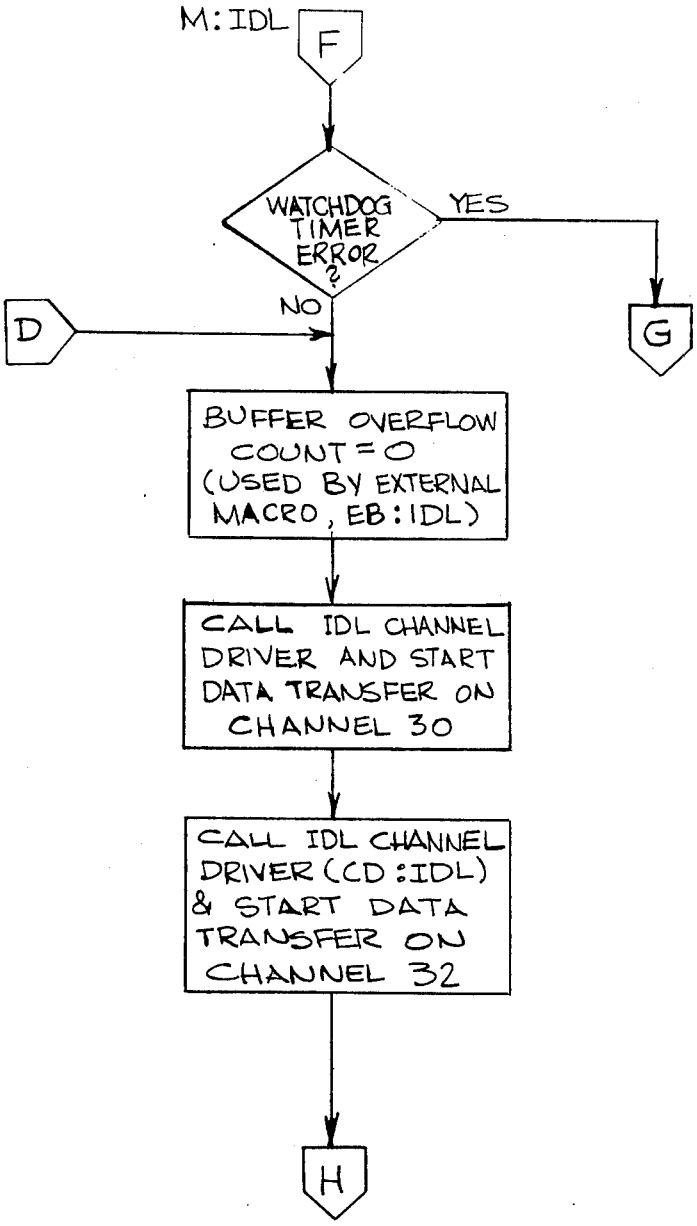
Figure 14E:
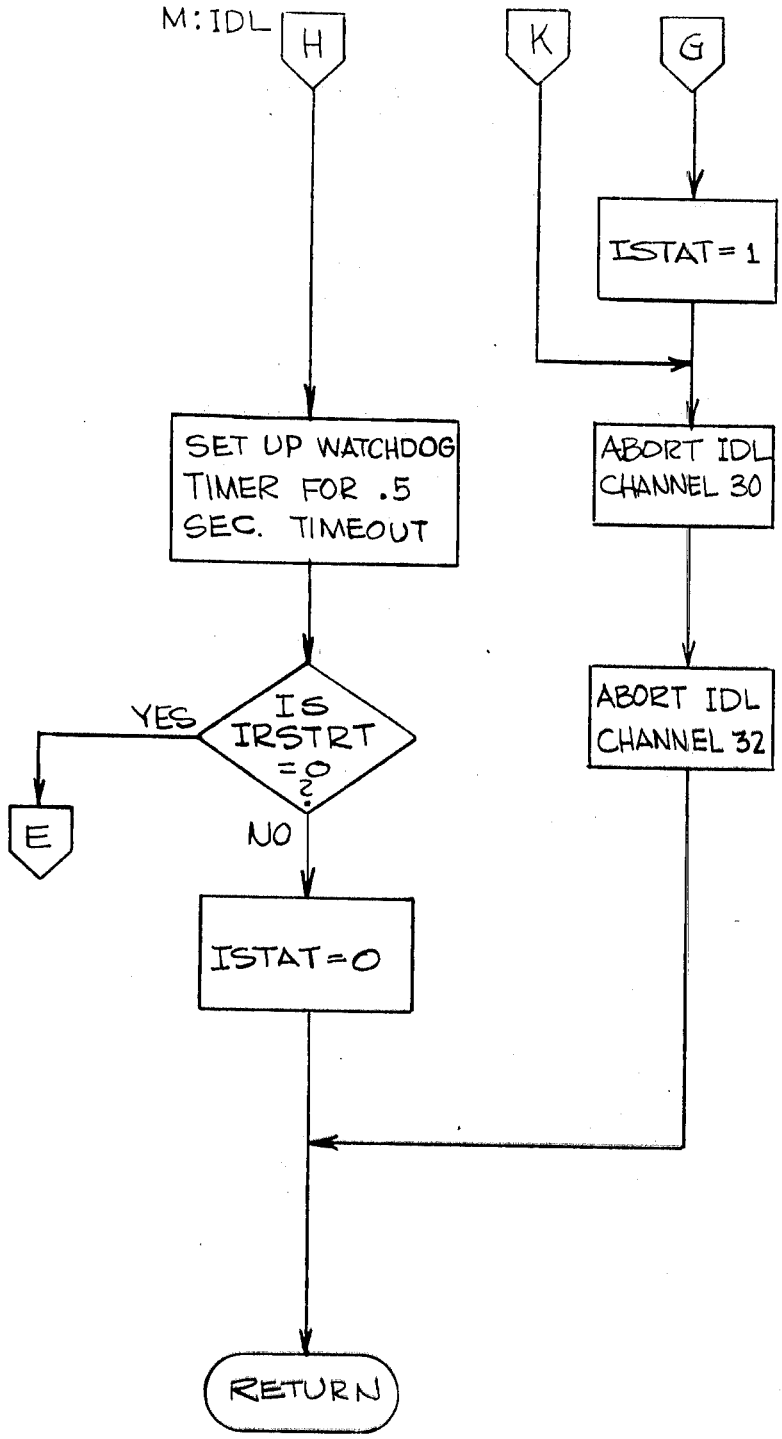

DISC MAP, see FIG. 12. Program address in disc storage 192.

CORE MAP, see FIG. 13. Program address in hexadecimal core storage 194.

SERVICE PROGRAMS (198)

IDL Handler, M:IDL, see FIGS. 14A–E. This routine handles all data transfers between the IDL hardware (channels 30 and 32) and the gage data input subroutine — GAGEIN. It communicates to the IDL hardware via the IDL channel driver CD:IDL. A double buffering scheme is used to speed up the total data transfer time by initiating an additional IDL transfer on both channels to a second data buffer just before exiting from the handler. In this way data can be transferred into this second buffer by the IDL hardware using service request interrupts SRI's executed in the out-of-sequence range while the gage software is busy processing data from the first buffer. When this processing is completed, the handler is re-entered. If the data transfer on the second buffer is not complete, the task is suspended until the IDL external MACRO routine detects two buffer overflow interrupts. The task is unsuspended by the IDL external MACRO routine EB:IDL when two buffer overflows have been counted. If the data transfer on the second buffer is complete, or after the task is unsuspended by EB:IDL, the buffers are effectively switched and a data transfer using buffer 1 is initiated and an exit is made from the handler. The gage software now processes the data in buffer 2 and repeats the above sequence.

A watchdog timer with a 0.5 second timeout is set before initiating each IDL transfer. If two buffer overflows are not returned within this time period, the clock routine will unsuspend the task and sets the variable ISTAT=1 to indicate an IDL transfer timeout error.

The variable IBUF is set by this routine to indicate which buffer, 1 or 2, contains data from the last IDL transfer. The variable IRSTRT must initially be set to 0 by the calling task so that this routine knows when entry has been made for the first time. When IRSTRT=0, the double buffering mechanism is initialized. This routine then sets IRSTRT=1 to indicate that the double buffering operation is in progress. If entry to the handler is made with IRSTRT=−1, an abort IDL command is sent to both IDL channels to stop any transfer in progress. This command is usually initiated by the calling task before doing a call exit so that all IDL transfers are halted.

This routine calls the IDL channel driver CD:IDL and utilizes the IDL external MACRO routine EB:IDL. Therefore these routines must be linked with the IDL handler M:IDL.

Figure 15:
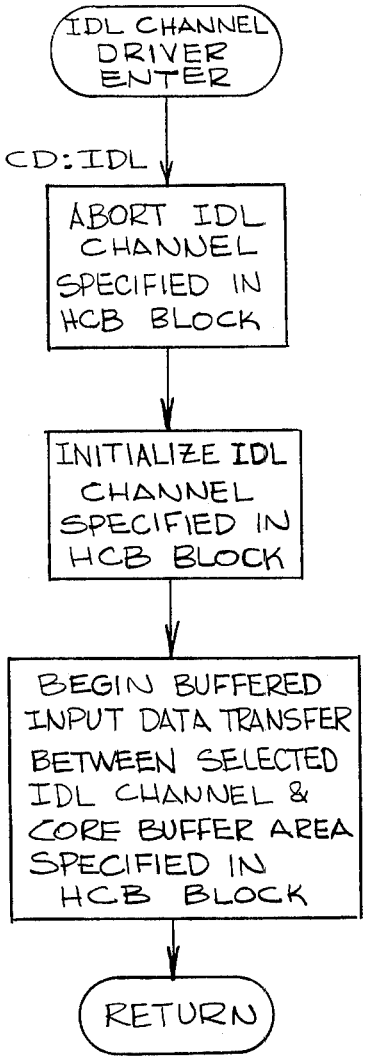

IDL Handler, CD:IDL, See FIG. 15. This routine is used to transfer data from the handler control blocks (HCB) defined in the IDL handler M:IDL to the IDL hardware (channels 30 and 32). Control is transferred to this routine by loading the address of the HCB into the B register and jumping to CD:IDL (CD:IDL must be declared external). The HCB is a 9 word table having the following format:

| Word No. | Explanation | Example Using Channel 30 |
|---|---|---|
| 0 | Forced Buffer Input IDL Code | DAT X'B30' |
| 1 | Abort IDL Code | DAT X'F30' |
| 2 | Return Address - 1 | ADL RTR1—1 |
| 3 | Blank | DAT 0 |
| 4 | Buffer Input IDL Code | DAT X'530' |
| 5 | Core Location Containing Addr. to data | DAT X'11FB' |
| 6 | Number of Words to be Transferred | DAT 20 |
| 7 | Address of Data Buffer | SIZE 1 |
| 8 | SRI Address Vector (100+SRI × 2) | DAT 354 |

This routine performs three functions using the HCB table. First, an abort code (HCB - word 1) is sent out on the I/O subsystem. The lower seven bits of this word define the channel number to be aborted. Second, a forced buffer input (HCB - word 0) is sent out on the I/O subsystem. This command initializes the IDL hardware on the selected channel. Third, the buffered input transfer code is sent out on the I/O subsystem to initiate the data transfer. The data is transferred into core memory from the selected IDL channel via service request interrupts (SRI). The pointers and counters used by the SRI's are set up by this routine using data supplied in the HCB's.

Figure 16:
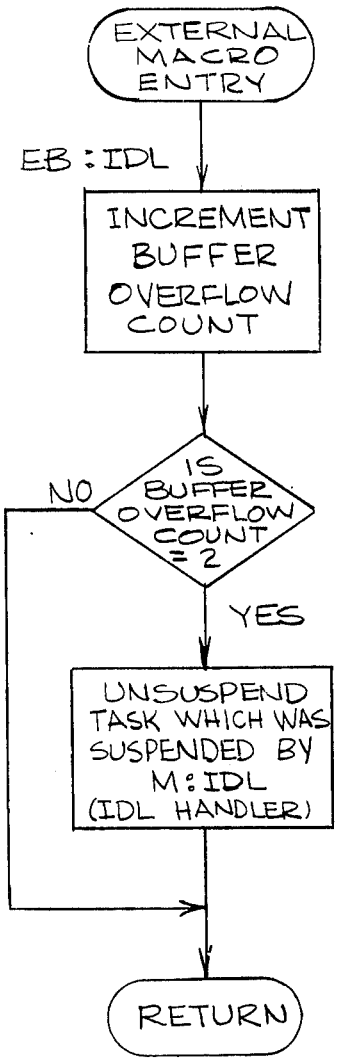

IDL Handler, EB:IDL, see FIG. 16. This routine is called by the POS/1 buffer overflow service request interrupt routine in the out-of-sequence instruction range in response to buffer overflow interrupts which occur when a buffered input data transfer on either of the IDL channels 30 or 32 is completed. Each entry to this routine causes the buffer overflow count work (ECB7) in the external MACRO control block to be incremented. When this count reaches 2, the task which was suspended by the IDL handler M:IDL is unsuspended. If this count is not 2, return is made to the POS/1 buffer overflow exit routine M:BOX and the state of the suspended task is unchanged. Thus, when the IDL handler M:IDL requests data from both IDL channels it clears the buffer overflow count and suspends the task. It will be unsuspended when the IDL external MACRO routine counts two completion buffer overflow interrupts.

Figure 17A:
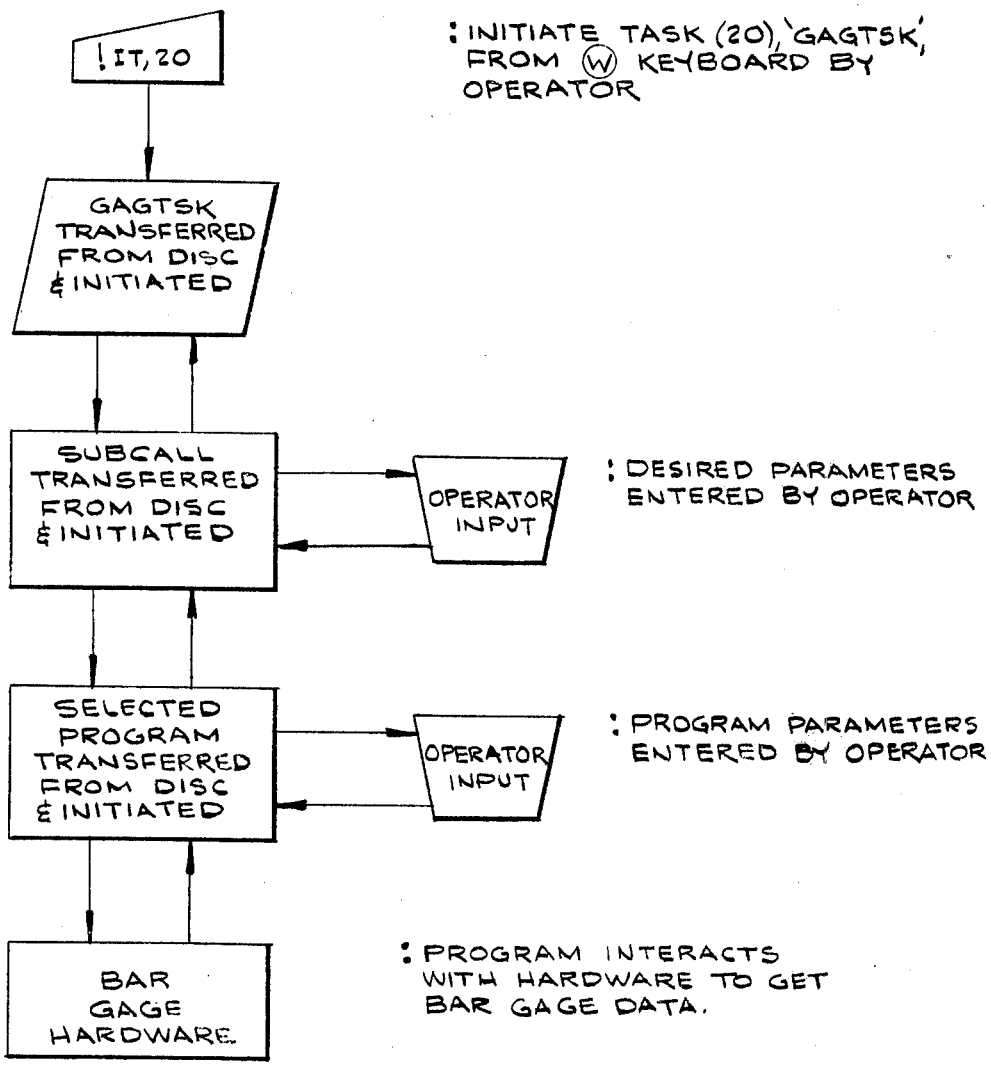
Figure 17B:
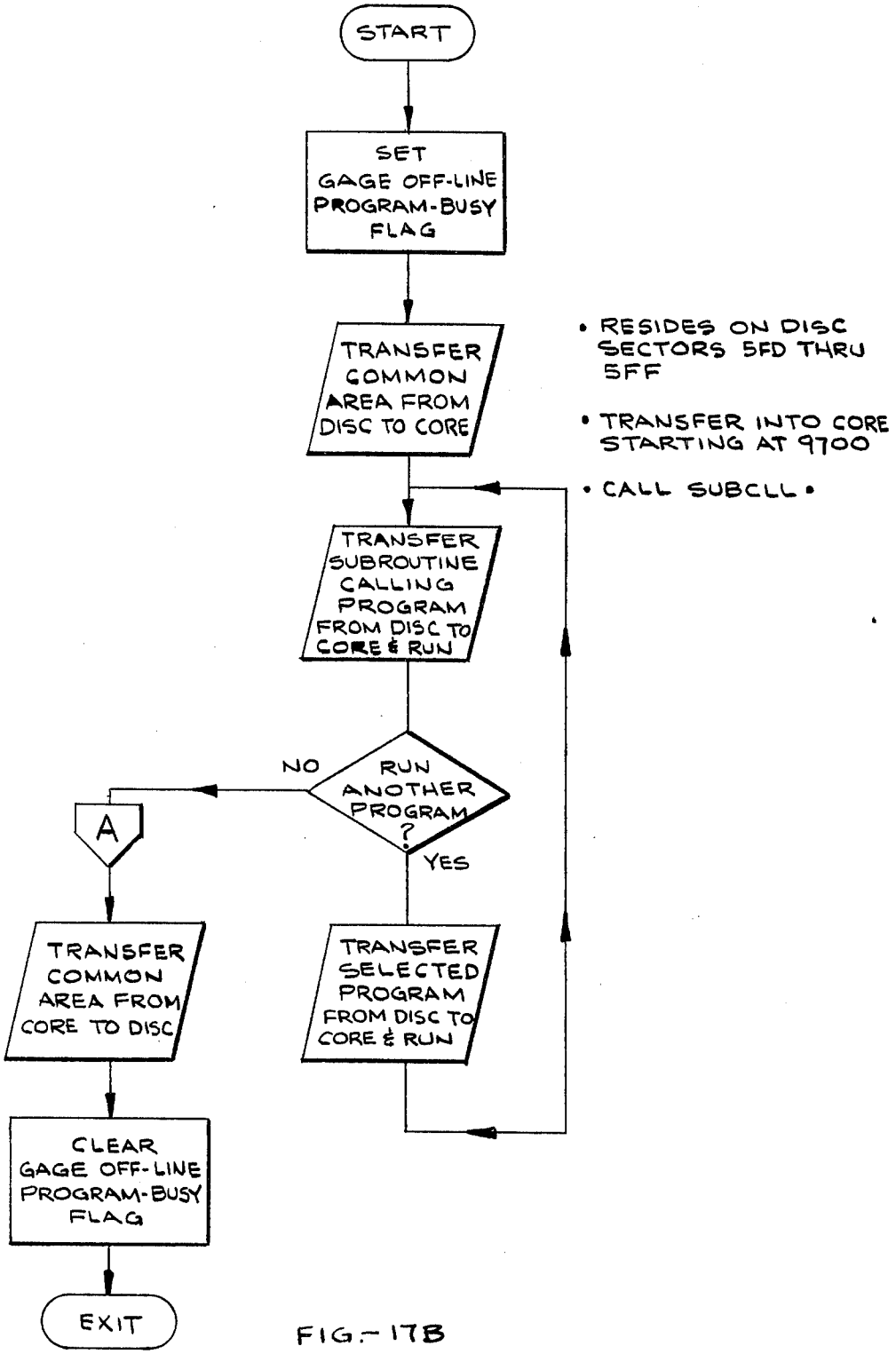

GAGTSK, see FIGS. 17A–B. This disc resident task (Task 20) is an off-line task designed to read disc resident off-line gage subroutine overlays into core, transferring control to them. GAGTSK calls a particular subroutine into core. In response to mnemonic parameters passed to it by the operator interactive subroutine caller overlay SUBCLL. All programs and their mnemonics are described in the listing of the subroutine SUBCLL. GAGTSK also transfers a disc resident common area into core, and, if disc sector switch 12 is write enabled, writes the updated common area back to the disc when exiting from the task.

An off-line busy flag IGAGOF is set on entry to this task, and is cleared upon exit.

Figure 18A:
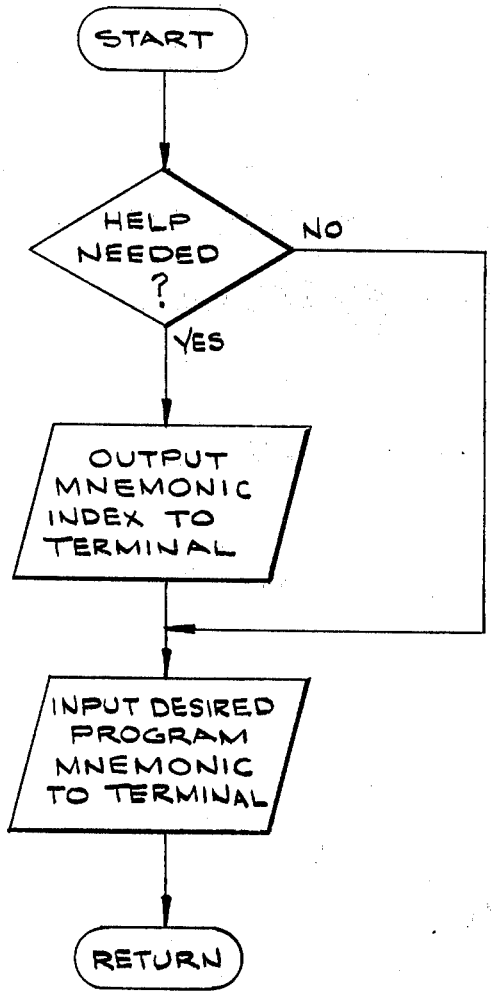

SUBCLL, see FIGS. 18A–B. This disc resident subroutine is an overlay, run in the off-line mode, by means of which an operator may interact with the gage off-line system to run any of the available off-line bar diameter gage programs. It is transferred from disc to core and run by the off-line gage task GAGTSK (Task 20) by means of a system monitor disc-read-and-transfer-control routine. Operator entered mnemonics determine subroutine disc sectors which are returned as subroutine parameters to GAGTSK, which in turn transfers and runs the desired subroutine overlay. Subroutine functions are described in this program listing, and are available to the operator in response to his request for assistance.

Figure 19:
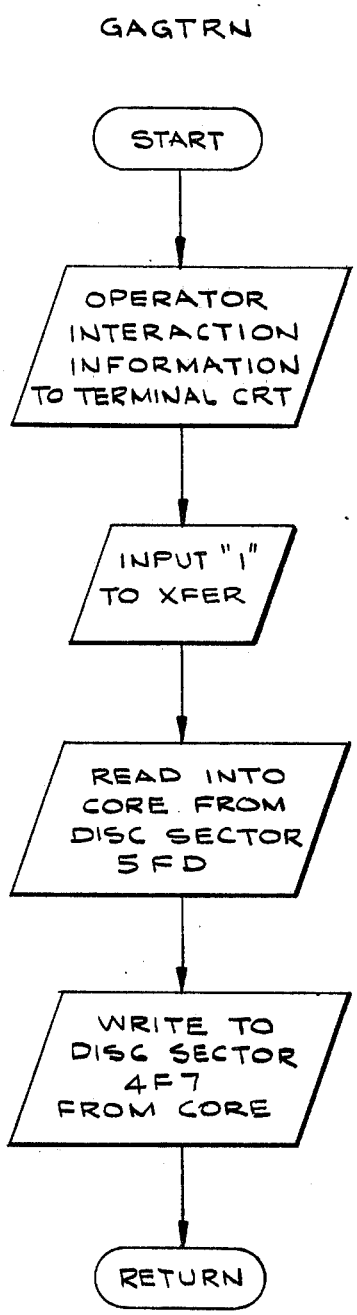

GAGTRN, see FIG. 19. This program runs in the gage off-line system. It transfers the 572 word gage data block from disc area 5FD to control system disc area 4F7. It performs a disc-core-disc transfer using the gage common area for intermediate storage. Disc switch 10 must be write enabled.

BAR GAGE DATA PROGRAM (199)

Figure 20A:
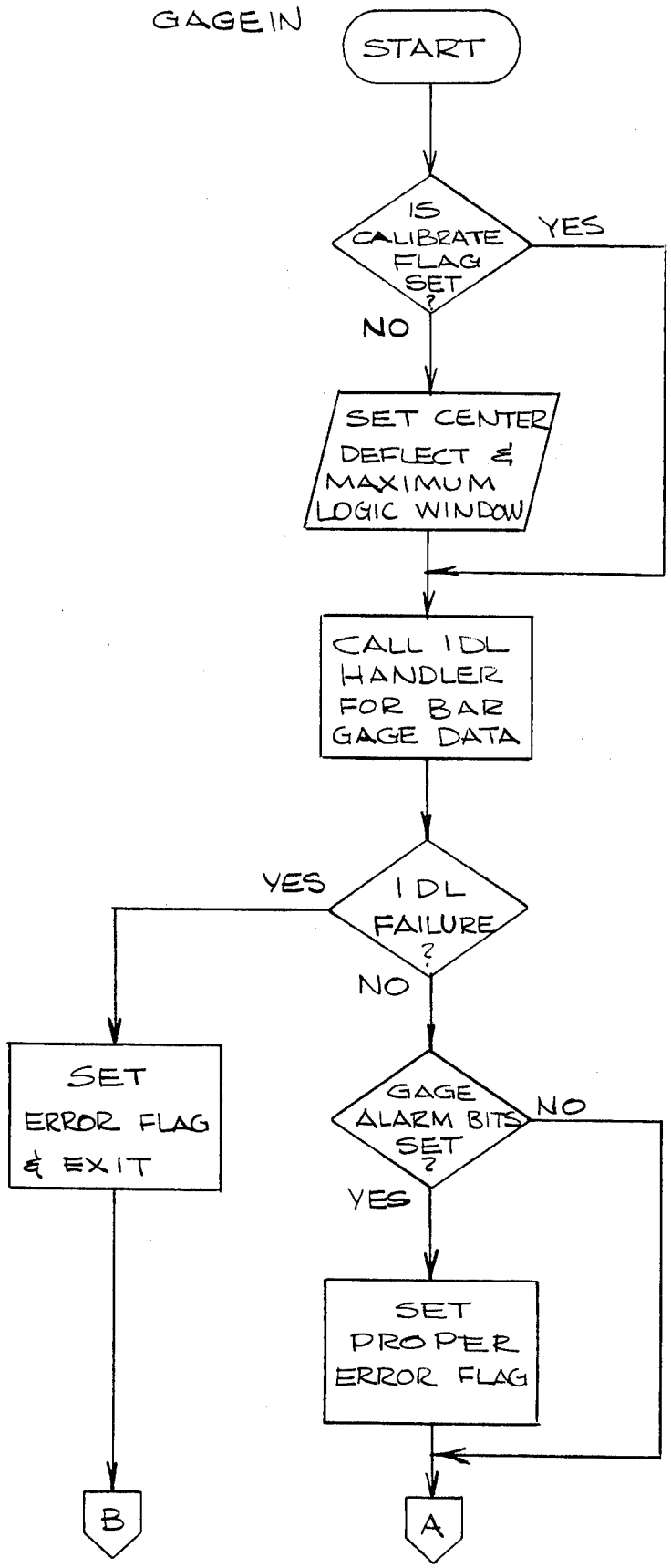
FIGS. 20A–B are flow charts of computer BAR GAGE DATA PROGRAM.
Figure 20B:
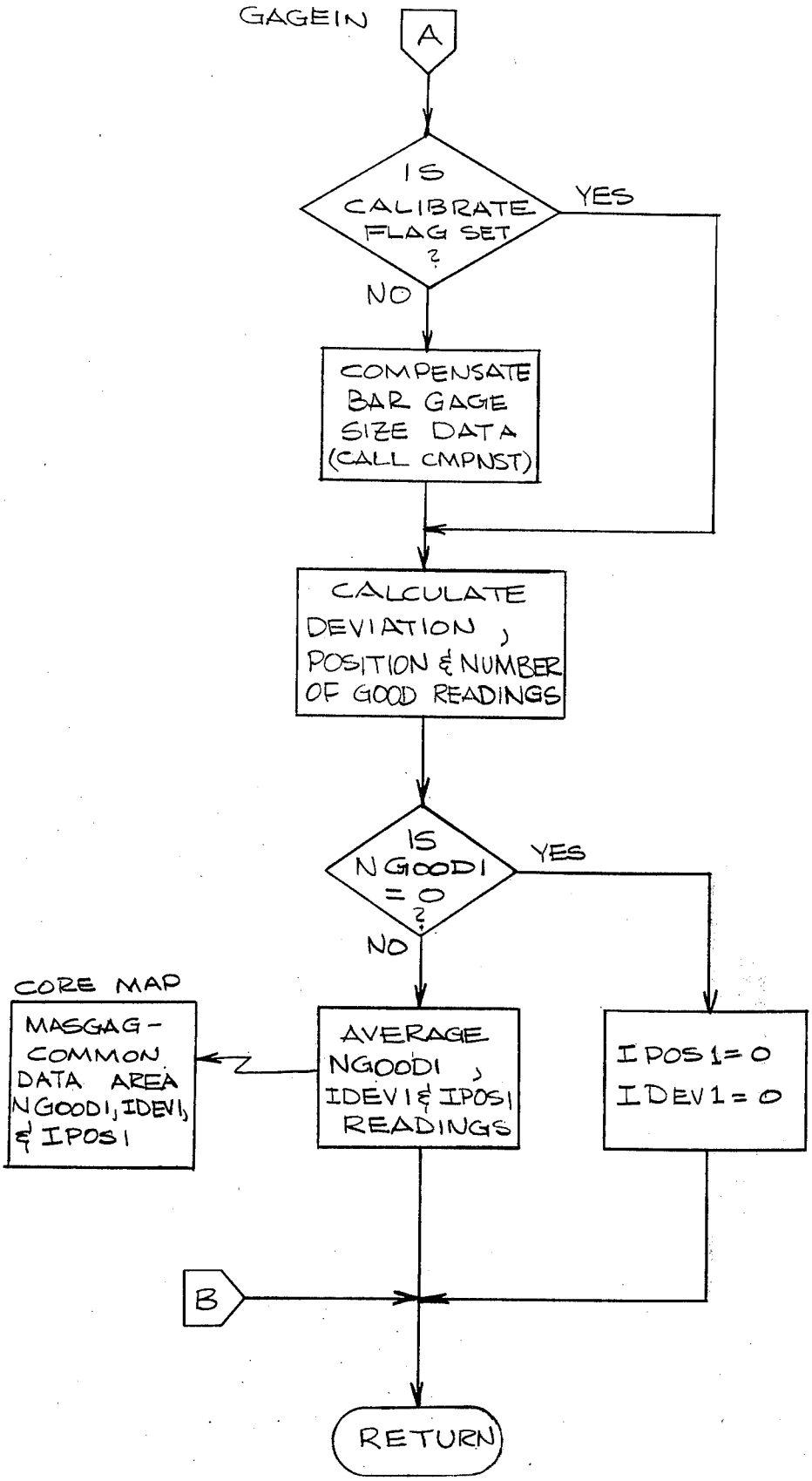

GAGEIN, see FIGS. 20A–B. This auxiliary subroutine is always appended to any subroutine requiring bar gage data. It calls the IDL handler (M:IDL, CD:IDL, EB:IDL), also appended, to actually acquire the bar position and diameter data, and the compensate subroutine (CMPNST), also appended, if compensation is required. It averages the good readings returned, both bar position and diameter, calculates deviations, and stores the results in common tables. Validity tests are made and error flags set as needed.

COMPENSATION PROGRAMS (200)

Figure 21A:
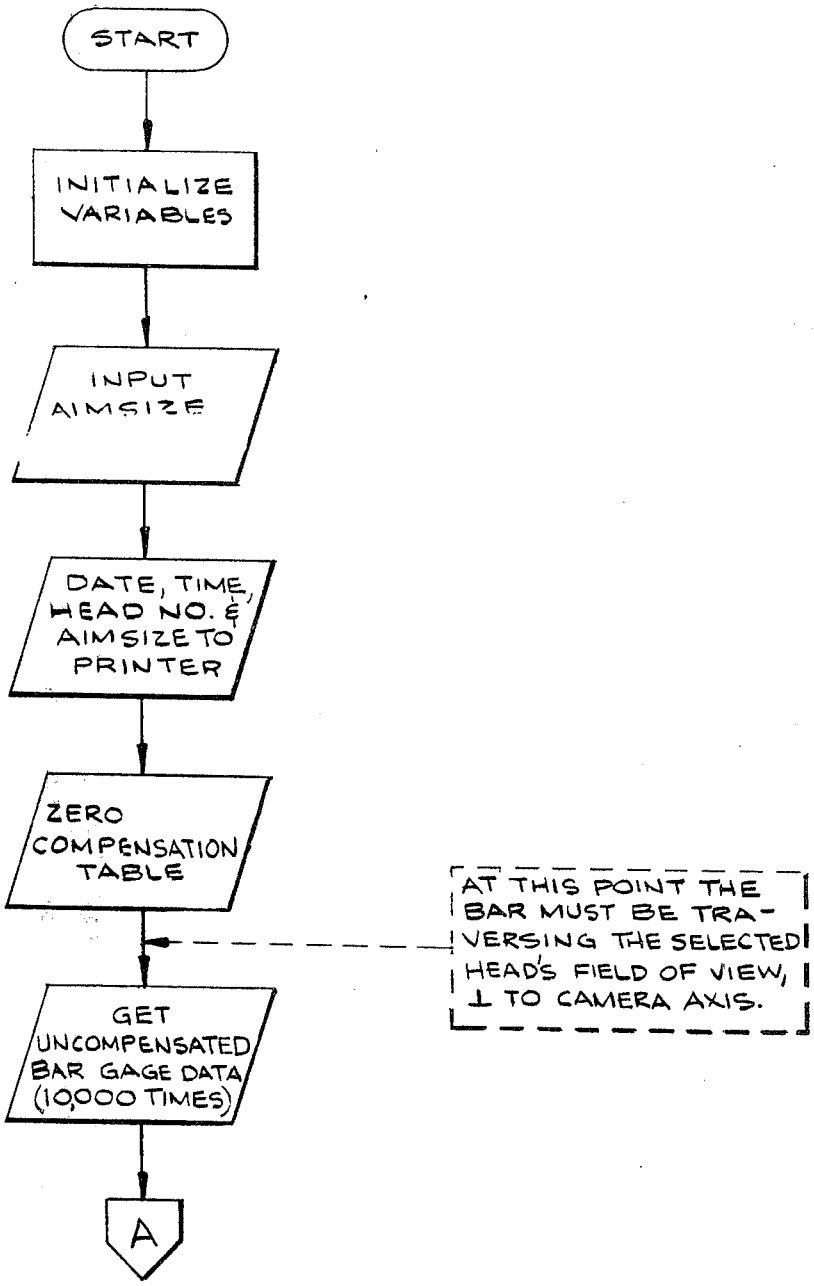
Figure 21B:
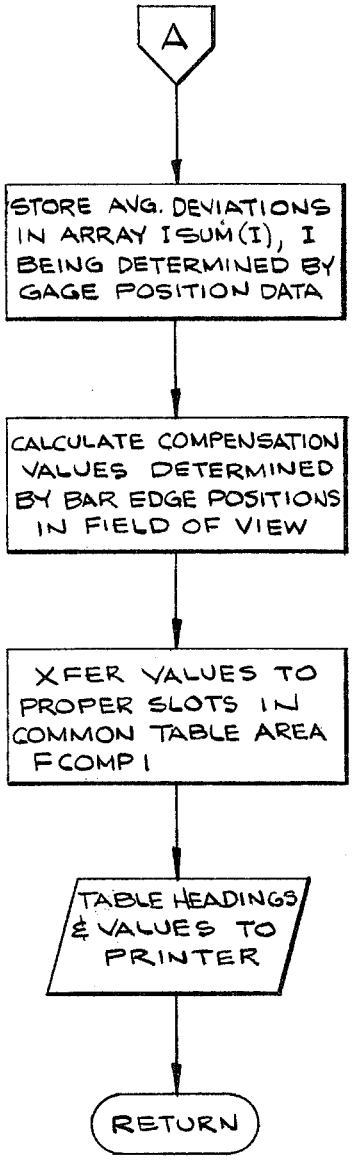

GAGMAP, see FIGS. 21A–C. This disc resident subroutine is an overlay, run in the off-line mode, which generates a compensation table used by on-line bar diameter gage tasks and subprograms, and those off-line gage programs requiring compensated size data. The tables reside in a common area, and are used to compensate for bar signal non-linearities across its field-of-view. The tables are formatted and output to printer 63. This program is required to be run before any bar-diameter data can be considered valid. It is invoked by the subroutine SUBCLL, and requires operator interaction.

The compensation map consists of 256 entries corresponding to the 256 possible bar positions. Element one represents the bottom of the total 4.096 inch field and element 256 represents the top of the field. Each element contains correction data to be subtracted from the measured bar size based on the positions of the top and bottom edges of the bar. The actual correction is performed by subroutine CMPNST. Using the edge 82, 83 positions rather than the center position allows the map to be used for all sizes of bar 10.

During the map building procedure, a ½ inch machined sample bar 10 is moved ±1.5 inches back and forth in a plane perpendicular to the optical axis. While bar 10 is being moved, GAGMAP is executed in the off-line calibration system. This program processes 10,000 measurements and calculates the average deviation at each increment of bar position. These intermediate results are stored in a 256 element table called ISUM.

The final compensation map based on bar edge 82, 83 positions is generated from the ISUM table by the following steps:

1. The compensation map is cleared.

2. A computer simulation is performed in which an imaginary ½ inch bar 10 is positioned at 0.016 inches above the center of the field-of-view (slot 129). The positions of the top and bottom bar edges 82, 83 are calculated as follows:

$$\text{Top Edge } 83 = \frac{[\text{field-of-view center position} + 0.016 + \text{bar size}/2)]}{0.016} \quad \text{(Eq.1)}$$

-continued $$\text{Bottom Edge } 82 = \frac{[\text{field-of-view center position} + 0.016 - (\text{bar size}/2)]}{0.016} \quad \text{(Eq.2)}$$

EXAMPLE

Top Edge 83 = (2.048 inches + 0.016 inch + 0.5 inch /2) ÷ 0.016 inch = 144 (Eq. 3)

Bottom Edge 82 = (2.048 inches + 0.016 inch − 0.5 inch /2) ÷ 0.016 inch = 113 (Eq. 4)

3. The value stored in the map at the upper edge 83 position (144) is the sum of the deviation stored in ISUM table corresponding to the position of the center of bar 10 (129) and the value stored in the map at the lower edge 82 position (113).

IMAP (upper edge 83 position) = ISUM (center bar position) + IMAP (lower edge position) (Eq. 5)

IMAP (144) = ISUM (129) + IMAP (113) (Eq. 6)

4. Steps 2 and 3 are repeated by incrementing the center position of the bar 10 to 0.032 inch above the center of the field-of-view, then 0.048 inch, 0.064 inch, etc. This is repeated until the upper edge 83 of bar 10 goes beyond +1.5 inch above the center of the field-of-view.

IMAP (145) = ISUM (130) + IMAP (114)

IMAP (146) = ISUM (131) + IMAP (115)

IMAP (147) = ISUM (132) + IMAP (116)

IMAP (220) = ISUM (205) + IMAP (189)

IMAP (221) = ISUM (206) + IMAP (190)

The upper half of the map is now complete.

5. The lower half of the map is filled in the same manner. Based on the same ½ inch sample bar 10 located at the center of the field-of-view (128) the positions of the upper and lower edges 83, 82 are calculated.

$$\text{Top Edge } 83 = (\text{field-of-view center} + \frac{\text{bar size}}{2}) \div 0.016 \quad \text{(Eq.7)}$$

$$\text{Bottom Edge } 82 = (\text{field-of-view center} - \frac{\text{bar size}}{2}) \div 0.016 \quad \text{(Eq.8)}$$

Top Edge 83 = (2.048 + 0.5/2)/0.016 = 143 (Eq. 9)

Bottom Edge 82 = (2.048 − 0.5/2)/0.016 = 112 (Eq. 10)

6. The map value for lower edge 82 of the bar (112) is the sum of the deviation stored in ISUM corresponding to the position of the center of the bar (128) and the map value stored at upper edge 83 of bar 10 (143).

IMAP (lower edge 82 position) = ISUM (center bar position) + IMAP (upper edge 83 position) (Eq. 11)

IMAP (112) = ISUM (128) + IMAP (143) (Eq. 12)

7. Steps 5 and 6 are repeated by successively decrementing bar 10 position by 0.016 inch from the center of the field-of-view until the lower edge 82 of bar 10 goes beyond - 1.5 inch from the center of the field-of-view.

IMAP (111) = ISUM (127) + IMAP (142)

IMAP (110) = ISUM (126) + IMAP (141)

IMAP (109) = ISUM (125) + IMAP (140)

IMAP (36) = ISUM (52) + IMAP (67)

IMAP (35) = ISUM (53) + IMAP (68)

The lower half of the map is now complete.

8. Map positions above 221 and below 35 are not used. These positions correspond to the unused portion of the field-of-view in the shadow of the photocathode tube.

9. Map elements 111 to 143 to zero. This corresponds to an area ±0.25 inch from the center of the field-of-view.

10. The map corresponding to camera head 31 is shown in FIG. 21 and is stored in a common data area labeled FCOMP1.

Figure 22:
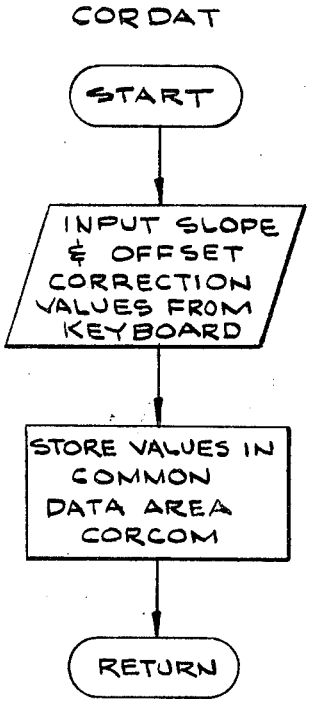

CORDAT, see FIG. 22. This program runs under the gage off-line system. Its purpose is to allow the operator to enter the slope and offset correction factors for camera head 31. The two variables are:

IMULT1 — Slope correction factor for camera head 31.

IOFST1 — Offset correction factor for camera head 31.

Slope correction is added to all bars by the field-of-view compensation subroutine CMPNST based on the following formula:

Size = (0.5 − Size)*IMULTI

Offset correction is added to all bar sizes by the field-of-view compensation subroutine CMPNST based on the following formula:

Size = Size − IOFST1

Figure 23:
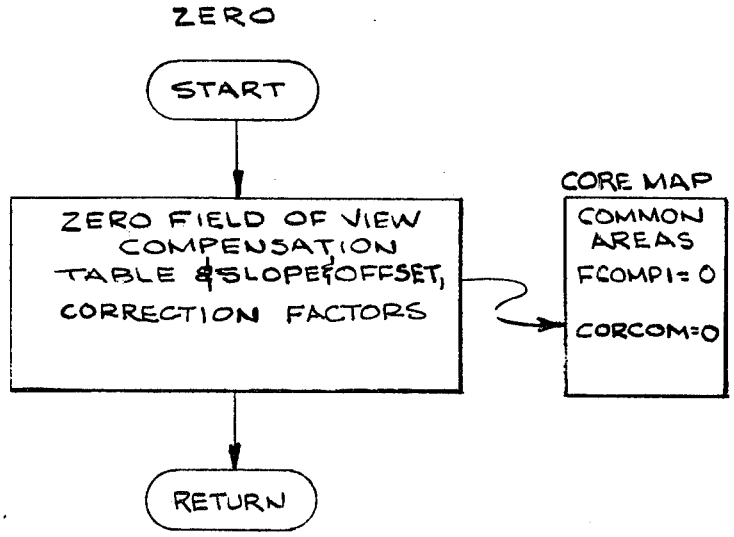

ZERO, see FIG. 23. This program runs in the offline gage system. Its purpose is to zero the compensation map and all slope and offset correction factors.

Figure 24A:
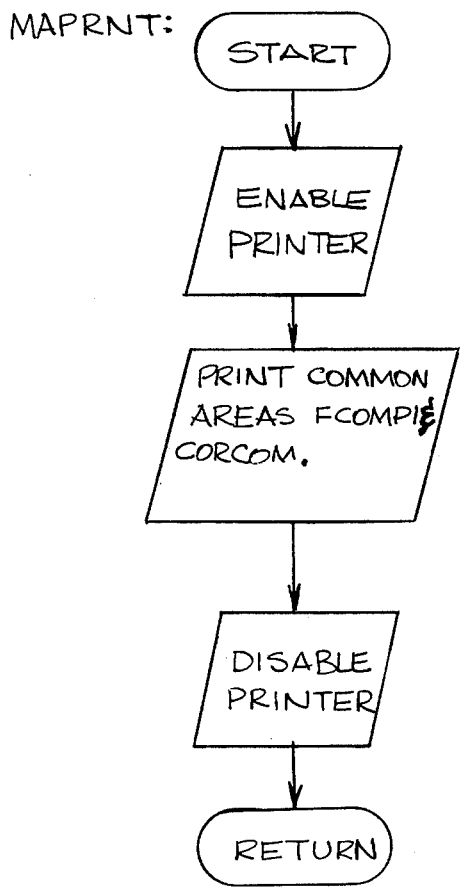

MAPRNT, see FIG. 24A–B. This program runs under the off-line gage system. It does not require operator intervention. Its purpose is to print the field-of-view compensation map and slope and offset correction factors, as shown in FIG. 24B.

Figure 25:
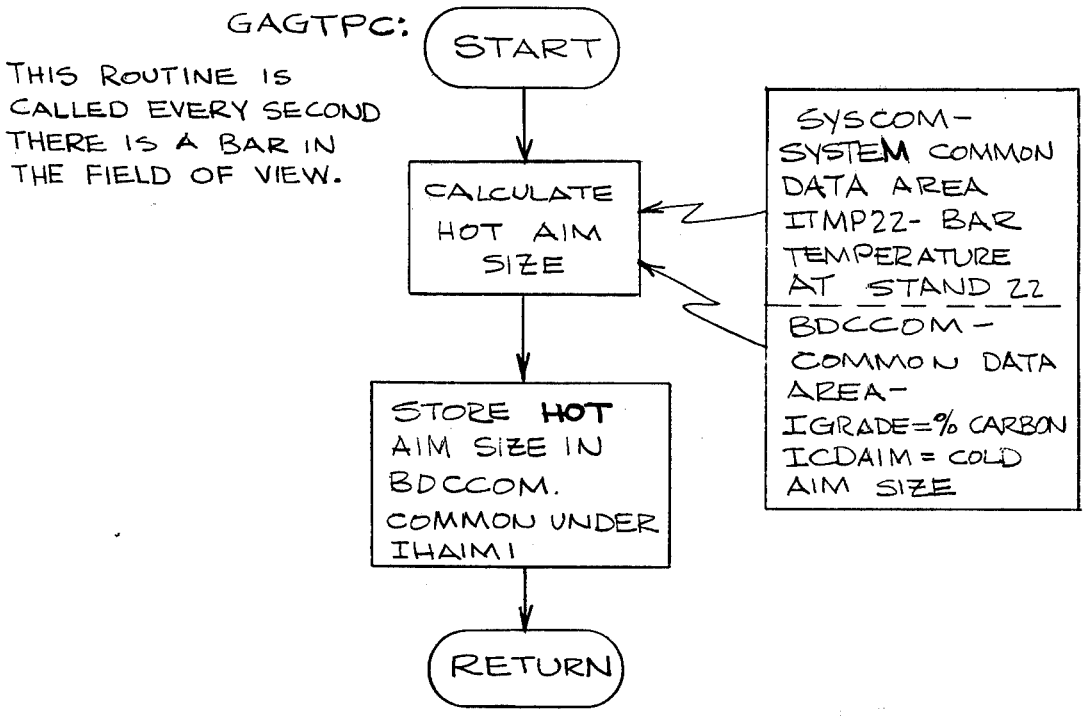

GAGTPC, see FIG. 25. This program calculates hot aim size based on an internally stored compensation equation. Three variables are required for this equation. First, the % carbon is obtained from IGRADE in common area BDCCOM. Second, the bar temperature is obtained from ITMP22 in common area SYSCOM. Third, the cold aim size is obtained from ICDAIM in common area BDCCOM. The calculated hot aim size is stored in IHAIM1 in common BDCCOM.

Figure 26:
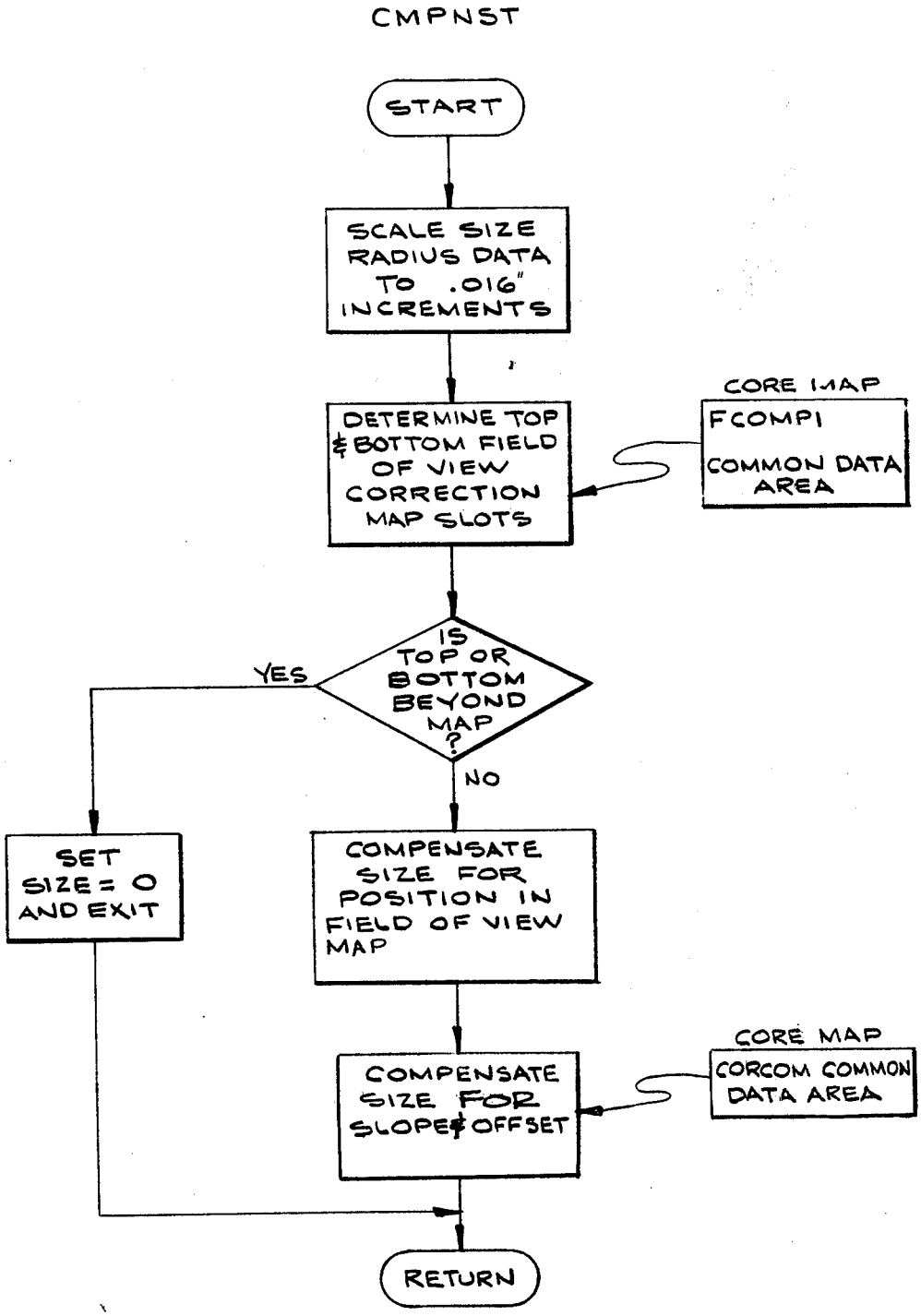

CMPNST, see FIG. 26. This auxiliary subroutine is appended to any subroutine requiring gage diameter data compensation. Specifically, this subroutine linearizes the bar measurement data for its position in the gage field-of-view and corrects the measurement data for slope and offset data per subroutine CORDAT.

Bar 10 size data from camera head 31 is linearized by the CMPNST subroutine using compensation map FCOMP1 generated by off-line program GAGMAP. Compensation is performed by the following steps.

1. The bar size and position data from accumulator 118 are used to determine the positions of the upper and lower edges 83, 82 of the bar 10 in the compensation map as follows:

Upper edge 83 position = (center bar position + bar size/2)/0.016

Lower edge 82 position = (center bar position − bar size/2)/0.016

If the center of a 1 inch bar is positioned ¾ inch above the center of the field of view, the position of the bar center is 2.048 inches + 0.75 = inch 2.798 inches. The upper and lower bar edge positions are determined as previously described. That is:

$$\text{Upper Edge 83 Position} = (2.748'' + \frac{1.0''}{2}) \div 0.016'' = 203 \quad \text{(Eq.13)}$$

$$\text{Lower Edge 82 Position} = (2.748'' - \frac{1.0''}{2}) \div 0.016'' = 140 \quad \text{(Eq.14)}$$

2. The compensation values corresponding to the upper and lower bar edges 83, 82 are obtained from the map and assigned values ICOR1 and ICOR2 respectively.

ICOR1 = IMAP (Upper Edge 83 Position) (Eq. 15)

ICOR2 = IMAP (Lower Edge 82 Position) (Eq. 16)

3. If both upper and lower edges 83, 82 are above the center of the field-of-view, then:

Corrected Bar Size = Uncorrected Size − ICOR1 + ICOR2

4. If both upper and lower edges 83, 82 are below the center of the field-of-view, then:

Corrected Bar Size = Uncorrected Size + ICOR1 − ICOR2 (Eq. 18)

5. If upper edge 83 is above the center of the field-of-view and lower edge 82 below, then:

Corrected Bar Size = Uncorrected Size − ICOR1 − ICOR2 (Eq. 19)

We claim:

1. A linearity correction system for an electro-optical system which gages a dimension of a moving bar, comprising:

(a) electronic camera head means aimed to receive an image of the moving bar and generate a raw camera signal, said raw camera signal requiring linearity correction for one or more linear and/or nonlinear errors from optical and/or electronic sources, excluding linear optical errors;

(b) electronic circuit means including means for processing the raw camera signal to produce a bar size pulse having a corresponding one or more of said errors;

(c) calculator means assimilating the bar size pulse and a corresponding one or more error-compensating signals for:

.1 compensating the bar size pulse for one or more of said optical and/or electronic errors in response to a corresponding one or more of said error-compensating signals, thereby producing a corrected bar size pulse, and .2 storing the corrected bar size data; and (d) means for utilizing the stored data to indicate and/or record corrected bar size.

2. The system of claim 1 wherein the electronic camera head means is back-lighted.

3. The system of claim 1 wherein the electronic camera head means includes a telecentric lens system to permit imaging of bar movement anywhere in a prescribed field-of-view.

4. The system of claim 1 wherein the electronic camera head means includes an image responsive device adapted to be scanned electronically, and the electronic circuit means further includes a sweep generator for driving the scanning of the image responsive device.

5. The system of claim 4 wherein the sweep generator is circuited for a single axis scan of the image responsive device.

6. The system of claim 4 wherein the sweep generator is circuited for a linear bidirectional sweep cycle having equal upsweep and downsweep half cycles.

7. The system of claim 6 further including the electronic circuit means to include means responsive to the bar size pulse for producing a first error-compensating signal relating to bar centerline position data, and the calculator means is modified to receive the first error-compensating signal and to effectively compensate the bar size pulse according to a predetermined value of corresponding bar centerline position data.

8. The system of claim 7 wherein the means within electronic circuit means produces first and second error-compensating signals relating to first and second bar centerline position data, this occurring in response to detecting successive bar size pulse leading edges in respective upsweep and downsweep halves of a camera means bidirectional sweep cycle, and determining the bar centerline position to be half of the distance between the successive bar size pulse leading edges.

9. The system of claim 4 wherein the sweep generator is circuited for a nonlinear bidirectional sweep cycle.

10. The system of claim 1 wherein the electronic camera head means includes a variable-gain image responsive device, and the electronic circuit means includes a self-balancing measuring loop having an automatic gain control circuit for varying image device gain to maintain output current constant.

11. The system of claim 1 wherein the camera pulse processing means includes an autocorrelator for removing camera signal noise.

12. The system of claim 1 wherein the camera pulse processing means includes differentiated pulse edge detection circuitry for the raw camera signal and an auto-correlator to remove noise from the differentiated raw camera signal.

13. The system of claim 1 wherein the calculator means is a programmed computer adapted to receive first and second error-compensating signals and include a compensation program that will effectively correct each bar size pulse for camera field-of-view error in response to the first and second error-compensating signals.

14. The system of claim 1 wherein the calculator means is a programmed computer adapted to receive third and fourth error-compensating signals and include a compensation program that will effectively correct each bar size pulse for offset and drift factors in response to the third and fourth error-compensating signals, respectively.

15. The system of claim 1 further including means for sensing bar temperature and producing a bar temperature signal as a fifth error-compensating signal, and wherein the calculator means is a programmed computer adapted to receive the fifth error-compensating signal and include a compensation program that will effectively correct each bar size pulse to a cold size proportional to the bar temperature signal representing the fifth error-compensating signal.

16. The system of claim 15 further including means for producing a bar composition signal as a sixth error-compensating signal, and wherein the calculator means is a programmed computer also adapted to receive the sixth error-compensating signal and include a compensation program that will effectively correct each of the bar size pulses for bar composition effect on temperature correction in response to the fifth and sixth error-compensating signals.

17. The system of claim 1 further including a source of bar aim size data, and wherein the calculator means is a programmed computer adapted to receive the bar aim size data and include a bar size profile deviation program for storing bar size deviation from the aim size data.

18. A linearity correction method for an electro-optical method which gages a dimension of a moving bar, which method comprises:

(a) imaging a moving bar upon an electronic camera head means and generating a raw camera signal, said raw camera signal requiring linearity correction for one or more linear and/or nonlinear errors from optical and/or electronic sources, excluding linear optical errors;

(b) processing the raw camera signal to produce a bar size pulse which represents the bar dimension, said bar size pulse having a corresponding one or more of said errors;

(c) assimilating the bar size pulse and a corresponding one or more error-compensating signals and calculating:

.1 correction factors to compensate the bar size pulse for one or more of said optical and/or electronic errors and subsequently producing a corresponding corrected bar size pulse, and .2 storing the corrected bar size data; and (d) utilizing the stored data to indicate and/or record corrected bar size.

* * * * *

UNITED STATES PATENT AND TRADEMARK OFFICE

CERTIFICATE OF CORRECTION

PATENT NO. : 4,121,291

DATED : October 17, 1978

INVENTOR(S) : Joel L. Hoffner and Tom L. Galanis

It is certified that error appears in the above-identified patent and that said Letters Patent are hereby corrected as shown below:

Col. 12, line 65, "output 88" should read --output --8B--.

Col. 14. line 36. "as well as to reset" should read --as well as to the reset--.

Col. 15. line 3. "logic 37 0" should read --logic "0"-- (delete 37).

Col. 20. line 33. "work" should read --word--.

Col. 22. line 35. Table. between lines "IMAP (147) and IMAP (220)" insert three dots:

--IMAP (147)
.
.
.
IMAP (220)--.

Col. 23, line 2, Table between lines "IMAP (109) and IMAP (36)" insert three dots:

--IMAP (109)
.
.
.
IMAP (36)--.

UNITED STATES PATENT AND TRADEMARK OFFICE

CERTIFICATE OF CORRECTION

PATENT NO. : 4,121,291

DATED : October 17, 1978

INVENTOR(S) : Joel L. Hoffner and Tom L. Galanis

It is certified that error appears in the above-identified patent and that said Letters Patent are hereby corrected as shown below:

Col. 23, line 14, "143 to zero" should read --143 are zero--.

Col. 24, line 12, delete the "= )equal sign)" after "0.75" and insert after --inch--.

Col. 24, at end of line 33, the words should be inserted --(Eq. 17)--.

Signed and Sealed this

Tenth Day of July 1979

[SEAL]

Attest:

LUTRELLE F. PARKER

Attesting Officer

Acting Commissioner of Patents and Trademarks